US007251424B2

(12) United States Patent
Yoshizawa

(10) Patent No.: US 7,251,424 B2
(45) Date of Patent: Jul. 31, 2007

(54) METHOD AND APPARATUS FOR TIMING IMAGE FORMATION IN AN IMAGE-FORMING APPARATUS

(75) Inventor: Ryuichi Yoshizawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 10/742,865

(22) Filed: Dec. 23, 2003

(65) Prior Publication Data

US 2004/0175199 A1 Sep. 9, 2004

(30) Foreign Application Priority Data

Dec. 24, 2002 (JP) ..... 2002-373111
Jan. 31, 2003 (JP) ..... 2003-024966

(51) Int. Cl.
*G03G 15/00* (2006.01)

(52) U.S. Cl. ..... 399/50; 399/16; 399/43; 399/75; 399/407

(58) Field of Classification Search ..... 399/75, 399/43, 50, 76, 77, 16, 407; 271/288
See application file for complete search history.

(56) References Cited

U.S. PATENT DOCUMENTS 4,708,461 A 11/1987 Okuda et al. ..... 399/87
6,094,546 A 7/2000 Nakazato et al. ..... 399/38 X
6,282,387 B1 8/2001 Yamada ..... 399/75
2002/0159782 A1 * 10/2002 Tsuruya et al. ..... 399/50

FOREIGN PATENT DOCUMENTS

| | | |
|---|---|---|
| JP | 61-233753 A | 10/1986 |
| JP | 63-274970 | 11/1988 |
| JP | 4-65274 A | 3/1992 |
| JP | 5-50718 A | 3/1993 |
| JP | 7-256935 A | 10/1995 |
| JP | 9-30079 A | 2/1997 |
| JP | 10-319659 | 12/1998 |
| JP | 11-78173 A | 3/1999 |
| JP | 2000-313155 A | 11/2000 |
| JP | 2003-307990 A | 10/2003 |

* cited by examiner

*Primary Examiner*—Sophia S. Chen
(74) *Attorney, Agent, or Firm*—Fitzpatrick, Cella, Harper & Scinto

(57) ABSTRACT

This invention relates to an image forming apparatus including an image forming unit which forms an image on a medium for each page, and a notification unit which, when image formation start instructions cannot be successively issued to the image forming unit for successive pages to be formed on media, notifies the image forming unit of the interval between the instructions. The image forming unit shifts to a stop state when the notified interval exceeds a predetermined time.

35 Claims, 27 Drawing Sheets

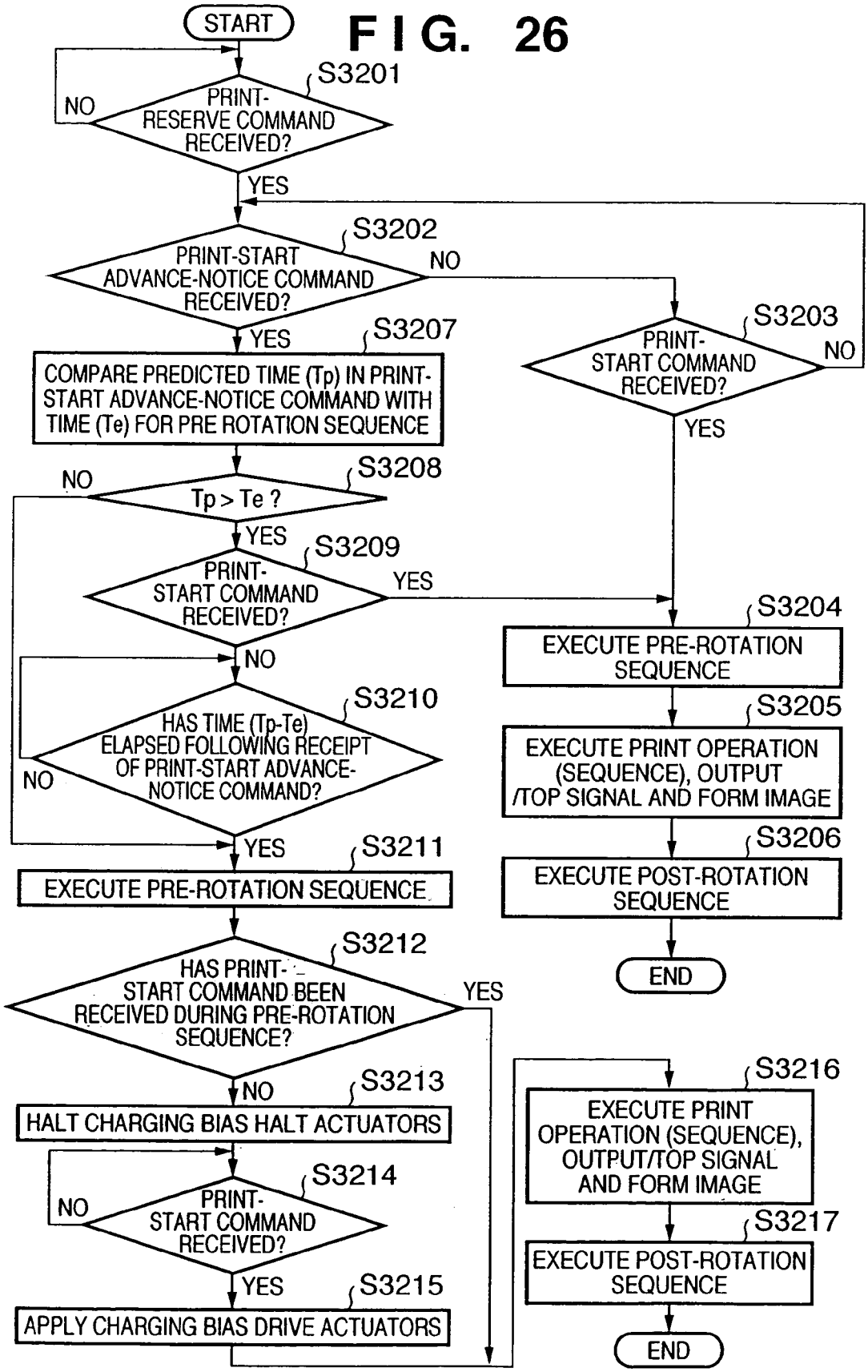
FIG. 26
START
S3201
PRINT-RESERVE COMMAND RECEIVED?
NO
YES
S3202
PRINT-START ADVANCE-NOTICE COMMAND RECEIVED?
NO
YES
S3203
PRINT-START COMMAND RECEIVED?
NO
YES
S3207
COMPARE PREDICTED TIME (Tp) IN PRINT-START ADVANCE-NOTICE COMMAND WITH TIME (Te) FOR PRE ROTATION SEQUENCE
S3208
Tp > Te ?
NO
YES
S3209
PRINT-START COMMAND RECEIVED?
YES
NO
S3210
HAS TIME (Tp-Te) ELAPSED FOLLOWING RECEIPT OF PRINT-START ADVANCE-NOTICE COMMAND?
NO
YES
S3211
EXECUTE PRE-ROTATION SEQUENCE
S3212
HAS PRINT-START COMMAND BEEN RECEIVED DURING PRE-ROTATION SEQUENCE?
YES
NO
S3213
HALT CHARGING BIAS HALT ACTUATORS
S3214
PRINT-START COMMAND RECEIVED?
NO
YES
S3215
APPLY CHARGING BIAS DRIVE ACTUATORS
S3204
EXECUTE PRE-ROTATION SEQUENCE
S3205
EXECUTE PRINT OPERATION (SEQUENCE), OUTPUT /TOP SIGNAL AND FORM IMAGE
S3206
EXECUTE POST-ROTATION SEQUENCE
END
S3216
EXECUTE PRINT OPERATION (SEQUENCE), OUTPUT/TOP SIGNAL AND FORM IMAGE
S3217
EXECUTE POST-ROTATION SEQUENCE
END

METHOD AND APPARATUS FOR TIMING IMAGE FORMATION IN AN IMAGE-FORMING APPARATUS

FIELD OF THE INVENTION

The present invention relates to an image forming apparatus such as a copying machine or printer of an electrophotographic or electrostatic storage type.

BACKGROUND OF THE INVENTION

Electrophotographic laser beam printers have prevailed as an image forming apparatus. The laser beam printer comprises a controller, an engine control unit which forms an image under the control of the controller, and a discharge option control unit which can switch a plurality of discharge bins. Some printers have a function of delivering printed paper sheets to different discharge bins while switching the discharge bins in forming (printing) an image.

Discharge operation of paper sheets to different discharge bins will be explained.

FIG. 6 shows a communication sequence when printing is continuously done on two paper sheets to different discharge bins. The reference numerals of the building components of a printer are those shown in FIG. 2.

A controller 201 transmits print reservation command 1 (601) and print reservation command 2 (602) for two paper sheets to an engine control unit 203, and discharge bin 1 discharge reservation 1 (603) and discharge bin 2 discharge reservation 2 (604) to a discharge option control unit 202. After transmitting discharge bin 2 discharge reservation 2 (604), the controller 201 acquires from the discharge option control unit 202 a time necessary to move from discharge bin 1 to discharge bin 2 (605).

The controller 201 transmits print start command 1 (606) to the engine control unit 203. The engine control unit 203 outputs /TOP signal 1 (607) for the first paper sheet and starts print operation.

In transmitting a print start command for the second paper sheet, the controller 201 must widen the interval between the first and second paper sheets by the time necessary to switch the discharge bin by the discharge option control unit 202 (608).

At this time, if the controller 201 transmits a print start command before a normal print start timing, the engine control unit 203 ensures an optimal throughput and continues continuous printing (continues continuous printing without widening the interval between paper sheets). To prevent this, the controller 201 must transmit print start command 2 (609) at a timing when the interval between paper sheets enough to deliver transfer media to different discharge bins can be ensured.

FIG. 7 is a timing chart of the engine control unit when transfer media are delivered to different discharge bins. FIG. 7 assumes that print reservation commands for two paper sheets have already been transmitted from the controller 201.

If the controller 201 receives print start command 1 (704), the controller 201 starts a pre-rotation sequence. The engine control unit 203 applies a high charge AC voltage so as to rise at the end of the pre-rotation sequence (705). After the end of the pre-rotation sequence, the engine control unit 203 outputs /TOP signal 1 (714), and starts print operation on the first paper sheet.

To successively deliver paper sheets to different discharge bins, the controller 201 transmits print start command 2 (708) at a timing when the interval between paper sheets enough to deliver transfer media to different discharge bins can be ensured, i.e., a time C taken to switch the discharge bin after the normal print start timing (706).

The engine control unit 203 has not received any print start command till the normal (not switching the discharge bin) print start timing (706). Thus, after a post-rotation sequence is executed once, the engine control unit 203 waits for reception of print start command 2 (708), and then starts the pre-rotation sequence.

In the above sequence, the post-rotation sequence is executed after print operation on the first paper sheet. As a result, print operation on one paper sheet is repeated twice. The interval between paper sheets originally suffices to be widened by the time C taken to switch the discharge bin, but is widened by a time D further including the time of the pre-rotation sequence. A redundant down time is generated by the pre-rotation sequence for the second paper sheet.

To eliminate this down time, transmission of a print start command is waited without executing the post-rotation sequence even at the normal print start timing (706), and print operation starts simultaneously when a print start command is received.

FIG. 8 is a timing chart of the engine control unit 203 when the print start command is waited without executing the post-rotation sequence even if no print start command has been received until the normal print start timing but an unexecuted print reservation command has been received. FIG. 8 assumes that print reservation commands for two paper sheets have already been transmitted from the controller 201.

When the controller 201 receives print start command 1 (806), the controller 201 starts the pre-rotation sequence. The engine control unit 203 applies a high charge AC voltage so as to rise at the end of the pre-rotation sequence (807). Upon completion of the pre-rotation sequence, the engine control unit 203 outputs a /TOP signal (815), and starts print operation on the first paper sheet.

The controller 201 sends a print start command (809) the time C taken to switch the discharge bin after the next normal print start timing (816).

Although no print start command is transmitted till the next normal print start timing (807), the engine control unit 203 has already received a print reservation command for the second paper sheet, and waits for a print start command without starting the post-rotation sequence. Upon reception of the print start command (809), the engine control unit 203 outputs a /TOP signal (817), and starts print operation on the second paper sheet.

This sequence can prevent generation of a down time as shown in FIG. 7 because no pre-rotation sequence need be performed before printing on the second paper sheet even when the interval between paper sheets is widened.

In this case, an extra charge AC bias is applied by the discharge bin switching time C in comparison with normal continuous printing.

In general, the service life of a photosensitive drum depends on the rotation time of the photosensitive drum and the application time of a high charge AC voltage applied to the photosensitive drum. The service life of the photosensitive drum is often set in consideration of these factors.

For example, as for the high charge AC voltage, the application time is calculated on the basis of a high charge AC voltage applied for printing on one paper sheet (to be referred to as "intermittent printing" hereinafter).

FIG. 10 shows the application state of a high charge AC bias in intermittent printing. The high charge AC voltage is so applied as to rise immediately before an image formation start timing, and falls at the same time as the start of the post-rotation sequence (1004). The rise period A, the fall period B, and a period (between 1003 and 1004) during which the high charge AC voltage is applied during print operation are defined as a high charge AC voltage applied in intermittent printing, and the service life of the photosensitive drum is set.

In the sequence of FIG. 8, the application time of the high charge AC voltage becomes longer than an assumed application time of the high charge AC voltage, which is adopted for estimating the life time of the photosensitive drum, by a period E (=C−(A+B)). This means that the degradation rate of the photosensitive drum is faster than an assumed one.

FIG. 18 is a sequence chart relating to operation of the engine control unit 203. This is a sequence chart particularly for a case where the engine control unit 203 executes pre-processing (referred to below as a "pre-rotation sequence"), which is necessary in order to perform a printing operation, at the moment a print-reserve command is received from the controller 201.

First, when image information and a print instruction are accepted from the host computer 200, the controller 201 transmits a print-reserve command to the engine control unit 203 based upon the print instruction received (2410, 2411). Further, the controller 201 analyzes the received image information and converts it to bit data.

Upon receiving the print-reserve command, the engine control unit 203 starts the pre-rotation sequence (2411). The engine control unit 203 applies a high voltage such as an AC charging high voltage in such a manner that a high voltage will be obtained at the end of the pre-rotation sequence and also starts up an actuator required for the printing operation.

The controller 201 transmits a print-start command to the engine control unit 203 at the moment the analysis and conversion to bit data of the image information received from the host computer 200 are completed and it becomes possible to transmit a video signal to the engine control unit 203 (2412).

Following the end of the pre-rotation sequence, the engine control unit 203 waits for transmission of the print-start command from the controller 201, receives the print-start command and transmits the /TOP signal to start the printing operation (2412, 2420, 2421).

In a case where the engine control unit 203 has not received a print-reserve command and a print-start command by the next print-operations tart timing (referred to below as "normal print-start timing") for the purpose of continuing with successive printing, the engine control unit 203 suspends the printing operation and starts print-operation post-processing (referred to below as a "post-rotation sequence") (2413). In the post-rotation sequence, the engine control unit 203 halts the application of all high voltages, inclusive of the AC charging high voltage, as well as actuator drive.

In accordance with the sequence described in connection with FIG. 18, print pre-processing by the controller 201 and the pre-rotation sequence performed by the engine control unit 203 can be executed in parallel and the printing operation can be started as soon as the print pre-processing by the controller 201 ends. As a result, the time required for the first printing operation can be shortened.

In this case, however, the AC charging high voltage is applied needlessly for a period of time equivalent to the difference (Tr−Te) between a time period Tr, which extends from the moment the controller 201 transmits the print-reserve command to the moment the controller 201 transmits the print-start command (namely the print pre-processing time of the controller 201), and a time period Te required for the pre-rotation sequence.

In general, the service life of a photosensitive drum depends upon the length of rotation time of the photosensitive drum and the length of time the AC charging high voltage is impressed upon the drum. In many cases, therefore, the lifetime of the photosensitive drum is set taking these factors into account. For example, with regard to the AC charging high voltage, the AC charging high voltage applied in a case where a single sheet is printed (referred to below as "intermittent printing") is used as the reference when calculating the service life of the drum.

FIG. 17 illustrates application of a charging AC bias in intermittent printing. The AC charging high voltage is applied so as to rise immediately prior to the timing at which image formation starts, and decays at the same time that post-processing (the post-rotation sequence) for the printing operation starts (2304). The service lifetime of the photosensitive drum is set upon adopting rise time A of the AC charging high voltage, decay time B thereof and a period (2303 to 2304) in which voltage is applied during the print operation as the AC charging high voltage applied at the time of intermittent printing.

Accordingly, with the sequence of FIG. 18, the AC charging high voltage is applied for a length of time longer by (Tr−Te) than that set for application of the AC charging high voltage.

Thus, according to the prior art, the AC charging high voltage is applied for a period of time longer than that set in advance for application of the AC charging high voltage and, as a consequence, the photosensitive drum deteriorates faster than originally assumed.

SUMMARY OF THE INVENTION

According to one aspect of the present invention, an image forming apparatus including an image forming unit which forms an image on a medium for each page, and a notification unit which, when image formation start instructions cannot be successively issued to the image forming unit for successive pages to be formed on media, notifies the image forming unit of the interval between the instructions. The image forming unit shifts to a stop state when the notified interval exceeds a predetermined time.

In an image forming apparatus according to another aspect of the present invention, pre-processing, which is for performing a printing operation based upon information relating to time till start of the printing operation is commanded following scheduling of the printing operation, is executed in an engine control unit that executes printing on a transfer medium, whereby an excellent first-printout time is realized irrespective of the time necessary for processing image information, which is transmitted from a host computer, in a control unit. In addition, the speed at which consumables, inclusive of a photosensitive drum, deteriorate is retarded.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 26 is a flowchart of processing executed by an engine control unit conforming to the third embodiment of the present invention.

DETAILED DESCRIPTION OF THE PREFERRED EMBODIMENTS

[First Embodiment]

The first embodiment is related to a method of preventing any wasteful down time and decreasing the degradation rate of a photosensitive member by sending a command for suspending a post-rotation sequence (to be referred to as an "image formation timing suspend command" hereinafter) before sending a print start command from a controller to an engine control unit when the interval between paper sheets is widened from a normal one in processing of an option control unit such as switching of a discharge bin, or image rasterizing processing of the controller.

In the first embodiment, the interval between paper sheets is widened from a normal one by processing of the option control unit such as switching of the discharge bin.

<Arrangement and Basic Operation of Printer>

The schematic arrangement of a whole laser printer serving as an image forming apparatus will be explained with reference to FIG. 1.

Figure 1:
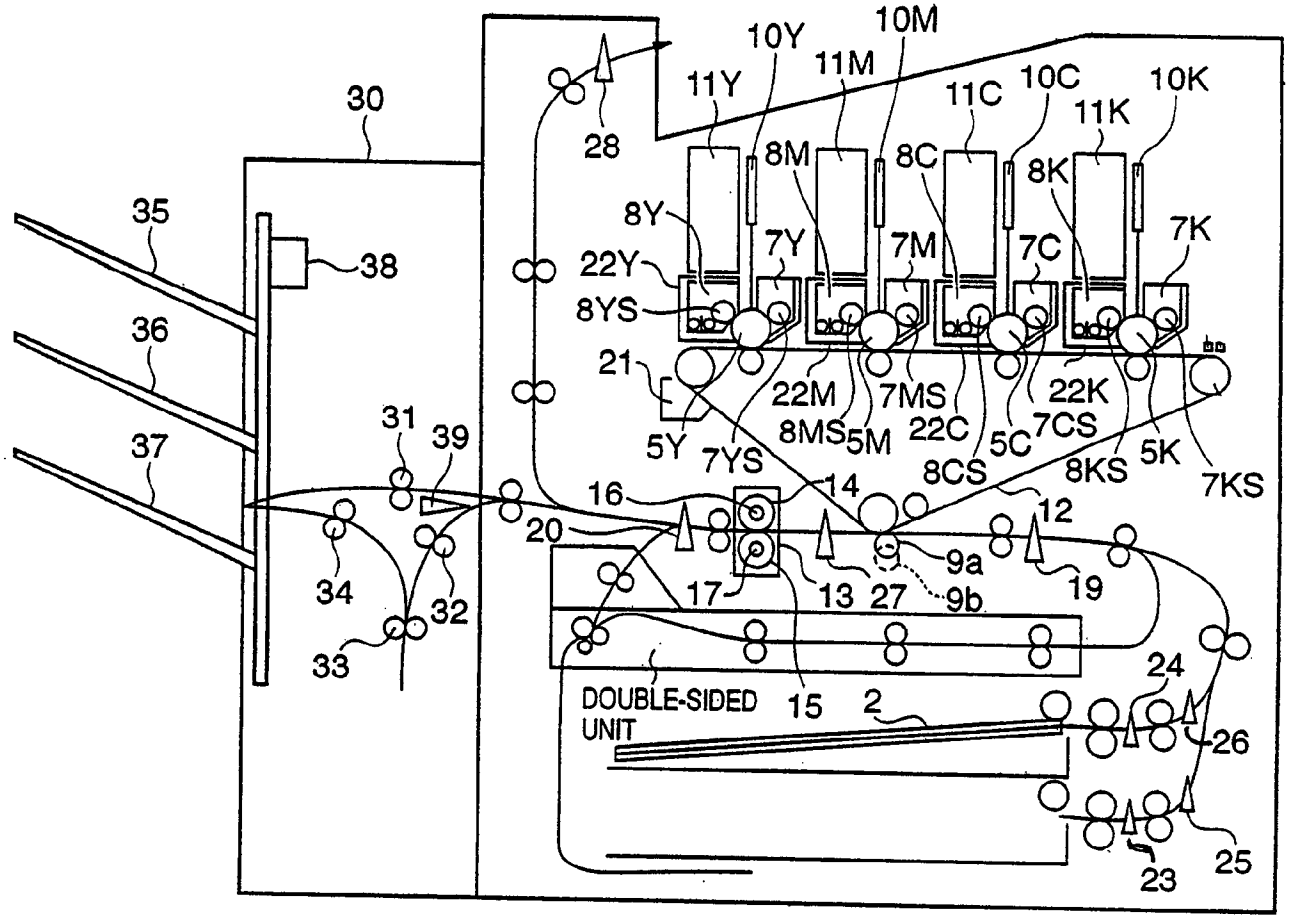
FIG. 1 is a sectional view showing the whole arrangement of a laser printer serving as an image forming apparatus.

In an image forming section, as shown in FIG. 1, the laser printer forms an electrostatic latent image by image light formed on the basis of an image signal transmitted from a controller (not shown), and develops the electrostatic latent image. The laser printer superposes and transfers visible images to form a color visible image, transfers the color visible image onto a transfer medium 2, and fixes the color visible image on the transfer medium 2. The image forming section comprises photosensitive members (5Y, 5M, 5C, and 5K) for stations parallel-arranged for respective developing colors, injection/charging means (7Y, 8M, 7C, and 7K) serving as primary charging means, developing means (8Y, 8M, 8C, and 8K), toner cartridges (11Y, 11M, 11C, and 11K), an intermediate transfer member 12, a paper feed portion, a transfer portion, and a fixing portion 13.

The photosensitive members (5Y, 5M, 5C, and 5K), the injection/charging means (7Y, 7M, 7C, and 7K) serving as primary charging means, and the developing means (8Y, 8M, 8C, and 8K) are mounted in process cartridges (22Y, 22M, 22C, and 22K) detachable from the image forming apparatus main body.

The photosensitive drums (photosensitive members) 5Y, 5M, 5C, and 5K are formed by applying an organic photoconductive layer around aluminum cylinders. The photosensitive drums 5Y, 5M, 5C, and 5K are rotated by transferring the driving force of a driving motor (not shown). The driving motor rotates the photosensitive drums 5Y, 5M, 5C, and 5K counterclockwise in accordance with image forming operation. Exposure beams to the photosensitive drums 5Y, 5M, 5C, and 5K are emitted from scanner portions 10Y, 10M, 10C, and 10K. The surfaces of the photosensitive drums 5Y, 5M, 5C, and 5K are selectively exposed to form electrostatic latent images.

The four injection/charging units 7Y, 7M, 7C, and 7K for charging the yellow (Y), magenta (M), cyan (C), and black (K) photosensitive members for the respective stations are arranged as primary charging means. The respective injection/charging units are equipped with sleeves 7YS, 7MS, 7CS, and 7KS.

The four developing units 8Y, 8M, 8C, and 8K which develop images in yellow (Y), magenta (M), cyan (C), and black (K) for the respective stations in order to visualize the electrostatic latent images are arranged as developing means. The respective developing units are equipped with sleeves 8YS, 8MS, 8CS, and 8KS. These developing units are detachable.

The intermediate transfer member 12 is in contact with the photosensitive drums 5Y, 5M, 5C, and 5K. The intermediate transfer member 12 rotates clockwise in forming a color image, rotates along with rotation of the photosensitive drums 5Y, 5M, 5C, and 5K, and receives transfer of visible images. In forming an image, a transfer roller 9*a* comes into contact with the intermediate transfer member 12 to clamp and convey the transfer medium 2. As a result, color visible images on the intermediate transfer member 12 are simultaneously superposed and transferred onto the transfer medium 2.

While color visible images are superposed and transferred on the intermediate transfer member 12, the transfer roller 9*a* abuts against the intermediate transfer member 12. At the end of print processing, the transfer roller 9*a* moves to a position 9*b*.

A fixing portion 13 fixes a transferred color visible image while conveying the transfer medium 2. The fixing portion 13 comprises a fixing roller 14 which heats the transfer medium 2, and a press roller 15 which presses the transfer medium 2 against the fixing roller 14. The fixing roller 14 and press roller 15 are hollow, and incorporate heaters 16 and 17, respectively. The transfer medium 2 holding a color visible image is conveyed by the fixing roller 14 and press roller 15, and receives heat and a pressure to fix the toner onto the surface.

The transfer medium 2 after fixing a visible image is discharged to a discharge portion, ending image forming operation.

A discharge option device 30 sorts transfer media by first, second, and third discharge bins 35, 36, and 37, and stacks the media on these bins. Transfer media are sorted to the respective bins by vertically moving the discharge bins 35 to 37 by a bin elevating motor 38. A flapper 39 switches conveyance of a transfer medium fed to the discharge option device 30 so as to switch the upper/lower surface of the transfer medium on the basis of an instruction from the controller. When the controller designates face-up, a transfer medium is guided to rollers 31 and directly fed to a discharge port. When the controller designates face-down, a transfer medium is guided by the flapper 39 to rollers 32 and rollers 33. The transfer medium is conveyed until the trailing end of the transfer medium temporarily exceeds the rollers 32. The rollers 33 are then reversed to supply the transfer medium from its trailing end to rollers 34, and the transfer medium is fed to the discharge port.

The printer manages the conveyance status by a lower conveyance sensor 23, upper conveyance sensor 24, lower conveyance sensor 25, upper conveyance sensor 26, registration sensor 19, pre-fixing sensor 27, fixing/discharge sensor 20, and discharge sensor 28 on the transfer medium convey path.

A cleaning means 21 cleans toner left on the photosensitive drums 5Y, 5M, 5C, and 5K and the intermediate transfer member 12. A cleaner vessel stores waste toner after transferring onto the intermediate transfer member 12 visible toner images formed on the photosensitive drums 5Y, 5M, 5C, and 5K, or waste toner after transferring onto the transfer medium 2 a four-color visible image formed on the intermediate transfer member 12.

Figure 2:
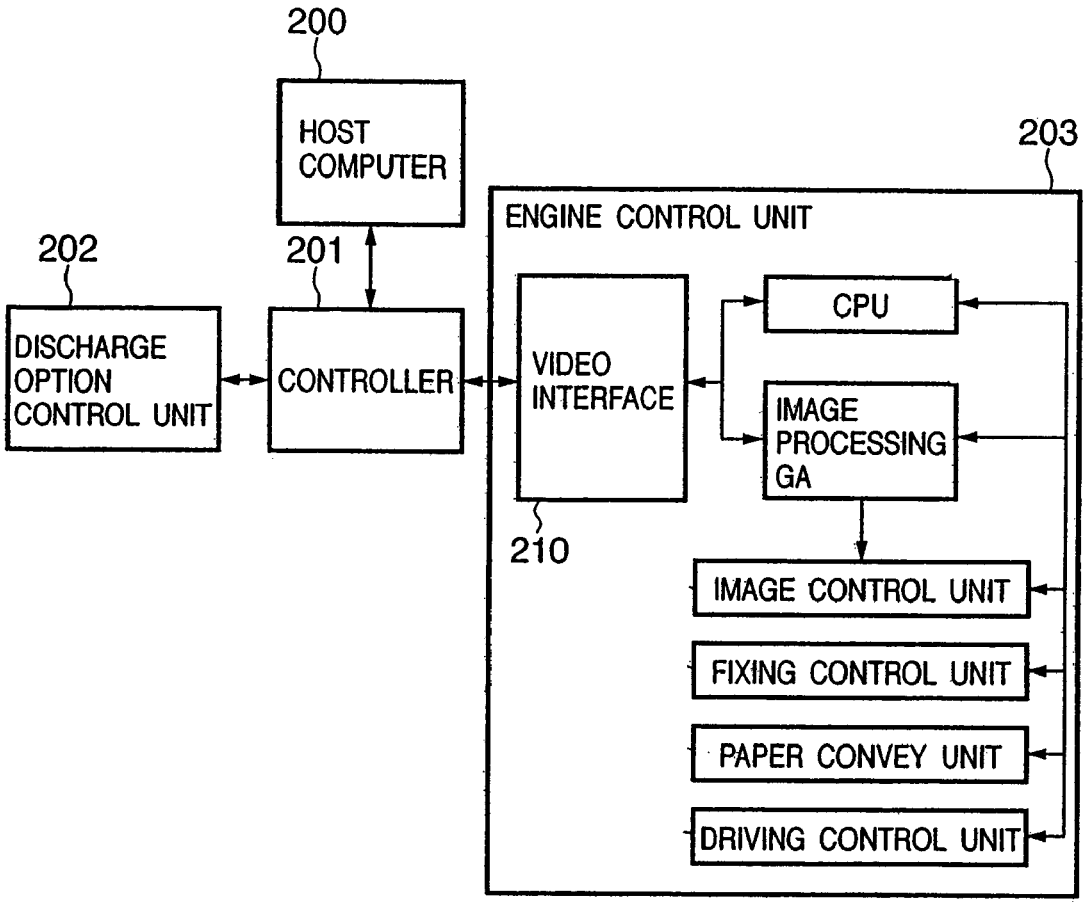
FIG. 2 is a block diagram showing the schematic system of the laser printer serving as an image forming apparatus.

FIG. 2 is a block diagram for explaining the system configuration of the image forming apparatus. A controller 201 can communicate with a host computer 200, discharge option control unit 202, and engine control unit 203. The controller 201 receives image information and a print instruction from the host computer 200, analyzes the received image information, and converts it into bit data. The controller 201 sends a print reservation command, print start command, and video signal for each transfer medium to the engine control unit 203 via a video interface 210. At this time, the controller 201 also sends an instruction on the use of a discharge control option to the discharge option control unit 202 on the basis of an instruction from the host computer 200.

The controller 201 transmits a print reservation command to the engine control unit 203 in accordance with a print instruction from the host computer 200, and transmits a print start command to the engine control unit 203 at a timing when printing becomes possible.

The engine control unit 203 makes print execution preparations in the order of print reservation commands from the controller 201, and waits for a print start command from the controller. Upon reception of a print instruction, the engine control unit outputs to the controller 201 a /TOP signal serving as the reference timing of outputting a video signal, and starts print operation in accordance with a print reservation command. /TOP signal may be output from controller 201 other than control unit 203. The controller 201 can be formed by an interface to the discharge option control unit 202, controller 201, and engine control unit 203, a processor, a memory, and the like.

Figure 5:
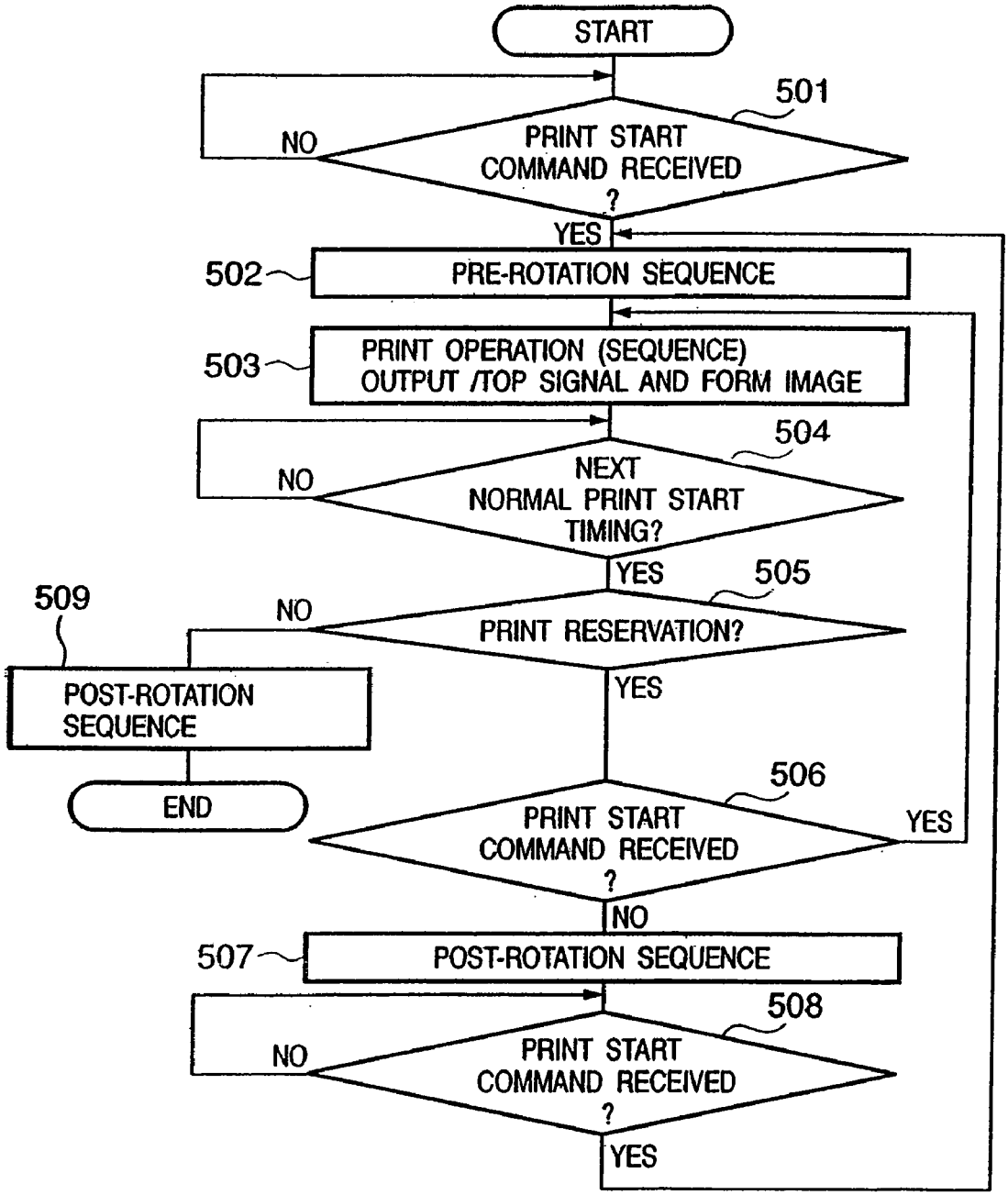
FIG. 5 (PRIOR ART)
FIG. 5 is a flow chart showing the conventional flow of the engine control unit.

FIG. 5 is a flow chart showing print operation of the engine control unit 203. Prior to printing, the controller 201 transmits to the engine control unit 203 and discharge option control unit 202 a reservation command (print reservation command, discharge bin reservation command, or the like) for reserving a necessary resource in advance. The reservation command specifies a resource to be used in correspondence with the order of print instructions to be issued. For example, the reservation command reserves the use of discharge bin 1 for the first print instruction, the use of discharge bin 2 for the next print instruction, or a paper feed cassette for use. The controller 201 then issues a print start signal to the engine control unit in order to print with reserved contents.

Upon reception of the print reservation command, the engine control unit 203 waits for reception of a print start command (501), and executes preprocessing for performing print operation (to be referred to as a "pre-rotation sequence" hereinafter) (502). After the end of the pre-rotation sequence, the engine control unit 203 outputs a /TOP signal, and starts print operation in accordance with a print reservation command for the first paper sheet (503). The /TOP signal corresponds to a vertical sync signal between the controller 201 and the engine control unit, and triggers transmission of image data of each page from the controller 201 to the engine control unit 203.

If the engine control unit 203 has not received the next print reservation command till the next print operation start timing (to be referred to as a "normal print start timing" hereinafter) for maintaining the throughput, the engine control unit 203 executes postprocessing (to be referred to as a "post-rotation sequence" hereinafter) of print operation, and ends print operation (504, 505, 509). The normal print start timing is given by generally selecting an optimal value under the restrictions of a medium convey mechanism, image forming mechanism, and the like. This value can also be obtained experimentally.

If the engine control unit 203 has received a print reservation command till the next normal print start timing and has received a print start command for the print reservation command, the engine control unit 203 starts print operation on the second paper sheet subsequently to the first paper sheet (502 and 506).

If the engine control unit 203 has received a print reservation command till the next normal print start timing and has not received any print start command (504, 505, 506 and 507), the engine control unit 203 executes the post-rotation sequence, waits for a print start command (508), and after receiving a print start command, starts the pre-rotation sequence (502).

Figure 3:
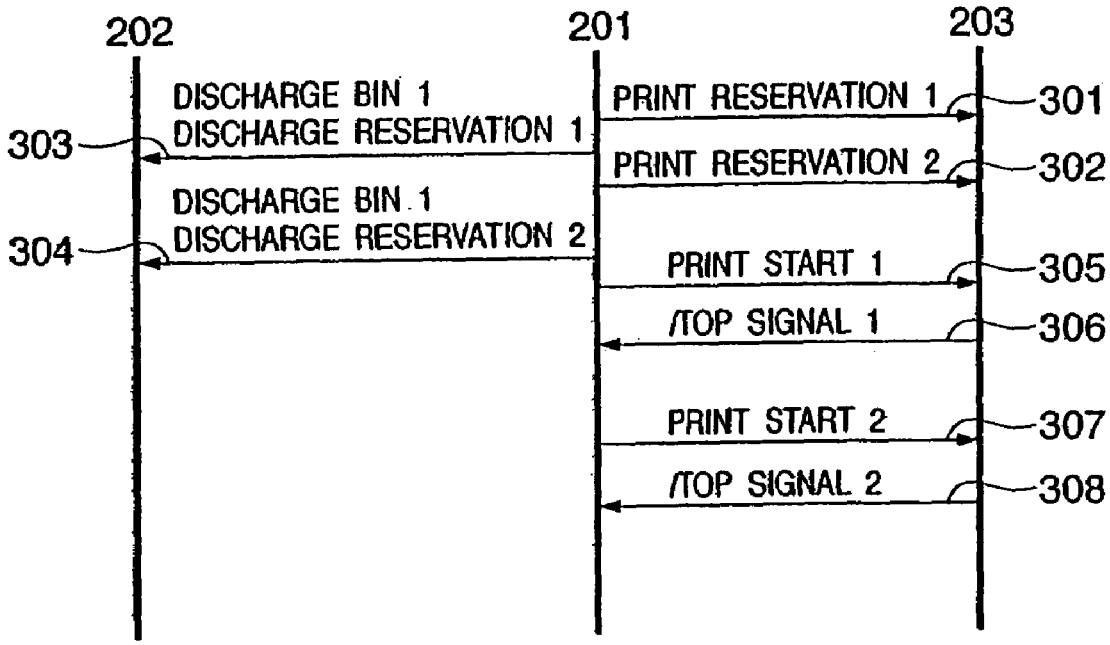
FIG. 3 (PRIOR ART)
FIG. 3 is a chart showing conventional communication sequence 1.

FIG. 3 shows a communication sequence when printing is continuously done on two paper sheets to the same discharge bin.

The controller 201 transmits print reservation command 1 (301) and print reservation command 2 (302) to the engine control unit 203, and discharge bin 1 discharge reservation command 1 (303) and discharge bin 2 discharge reservation command 2 (304) to the discharge option control unit 202. After that, the controller 201 transmits print start command 1 (305) to the engine control unit 203.

Upon reception of print start command 1 (305), the engine control unit 203 executes the pre-rotation sequence, outputs /TOP signal 1 (306) to the controller 201, and starts image forming operation.

In synchronism with /TOP signal 1 (306), the controller 201 outputs a video signal, and outputs print start command 2 (307) for the next print reservation command 2 (302).

Upon reception of print start command 2 (307), the engine control unit 203 transmits /TOP signal 2 (308) to the controller 201 at the normal print start timing of the second paper sheet, and continues print operation for the second paper sheet reserved by the print reservation command 2 (302) subsequently to the first paper sheet.

Figure 4:
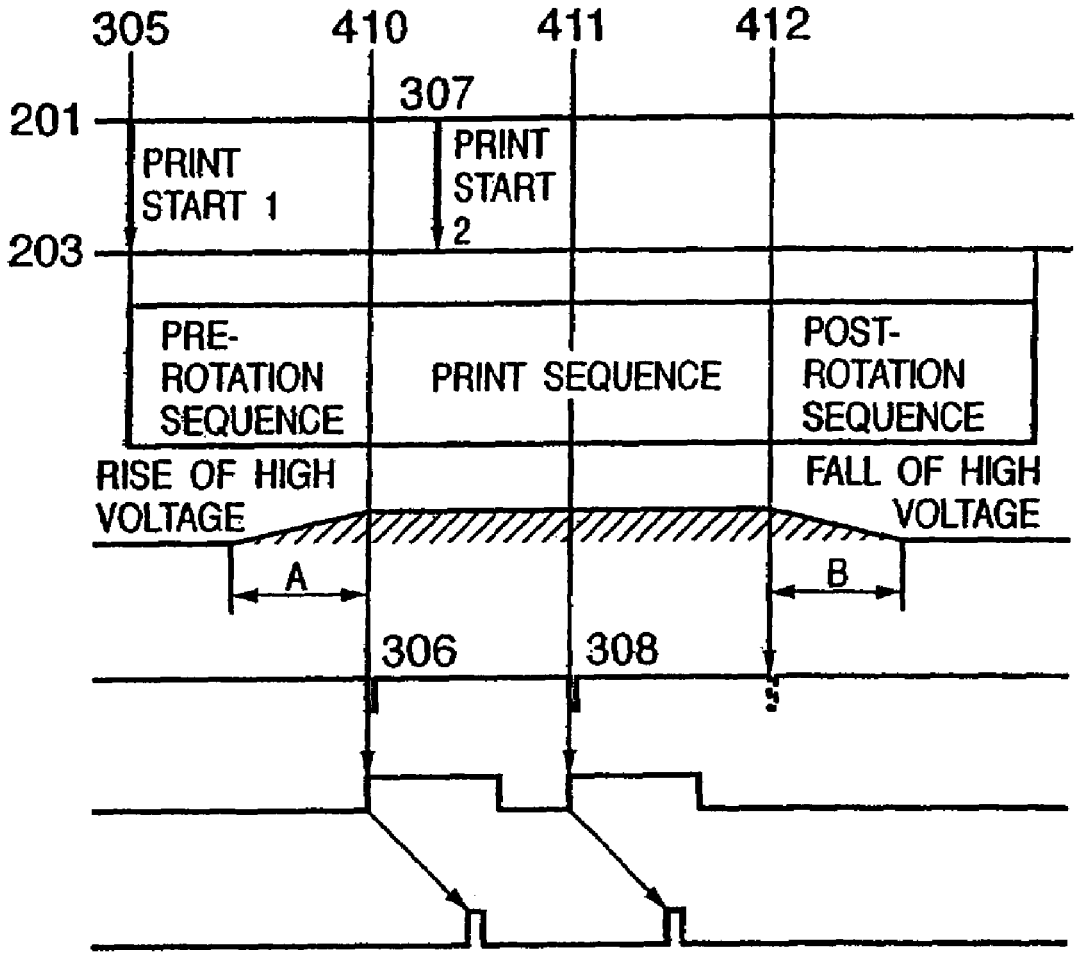
FIG. 4 (PRIOR ART)
FIG. 4 is a chart showing conventional sequence chart 1 of an engine control unit.

FIG. 4 is a timing chart of the engine control unit when printing is continuously done on two paper sheets to the same discharge bin. FIG. 4 assumes that print reservation commands for two paper sheets have already been transmitted from the controller 201.

If the engine control unit 203 receives print start command 1 (305) for a print reservation command for the first paper sheet, the engine control unit 203 starts the pre-rotation sequence. In the pre-rotation sequence, the engine control unit 203 applies a high charge AC voltage so as to rise at the end of the pre-rotation sequence (410). After the end of the pre-rotation sequence (simultaneously when the high charge AC voltage rises), the engine control unit 203 outputs /TOP signal 1 (306), and starts print operation on the first paper sheet.

If the engine control unit 203 has received print start command 2 (307) till the normal print start timing (411) of the second paper sheet after transmitting /TOP signal 1 (306) for the first paper sheet, the engine control unit 203 outputs /TOP signal 2 (308) at the normal print start timing (411) of the second paper sheet, and starts print operation on the second paper sheet subsequently to the first paper sheet. If the engine control unit 203 has not received any print reservation command and print start command for the third paper sheet till the next normal print start timing, the engine control unit 203 starts the post-rotation sequence and ends print operation. The engine control unit 203 stops application of the high charge AC voltage with the start of the post-rotation sequence (412).

The laser beam printer according to the first embodiment comprises the above arrangement, and performs the above basic operation.

<Communication Sequence in Printing>

Figure 9:
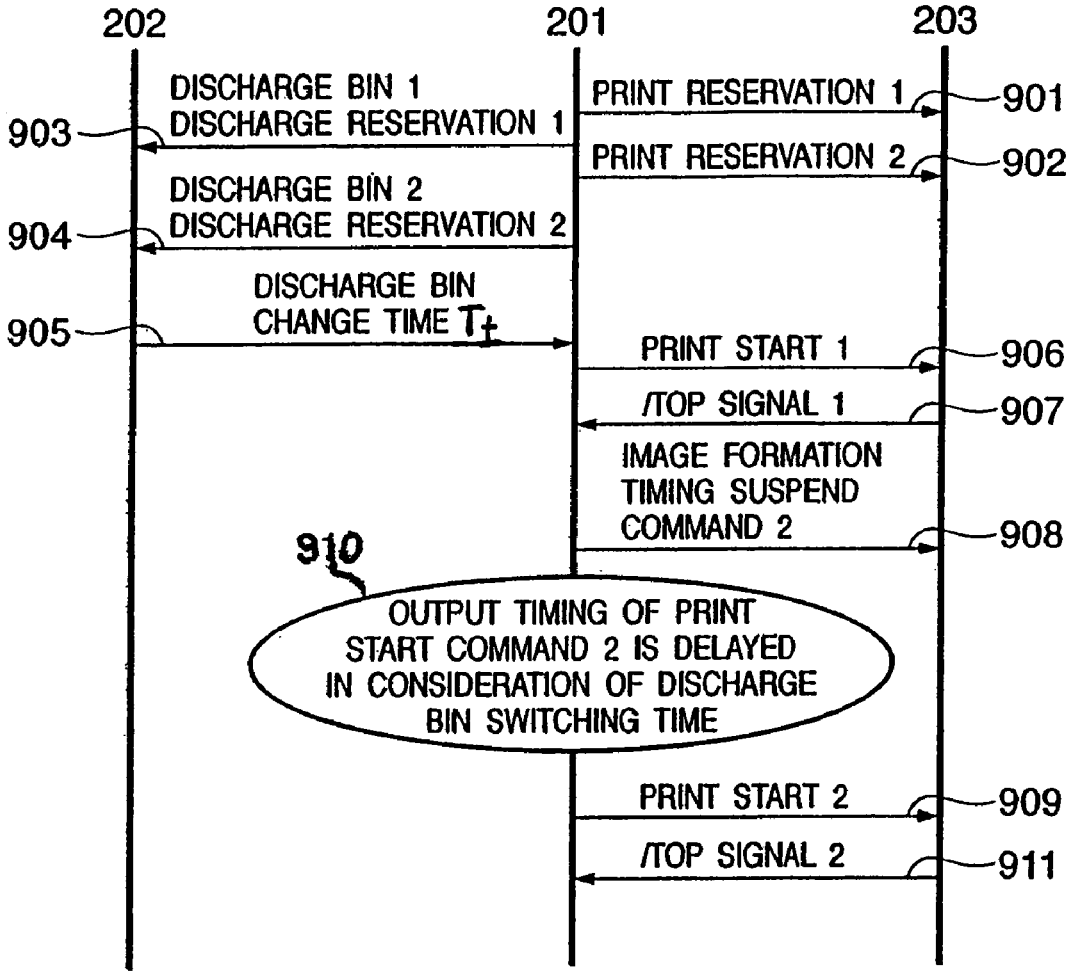
FIG. 9 is a chart showing a communication sequence according to the first embodiment.
Figure 10:
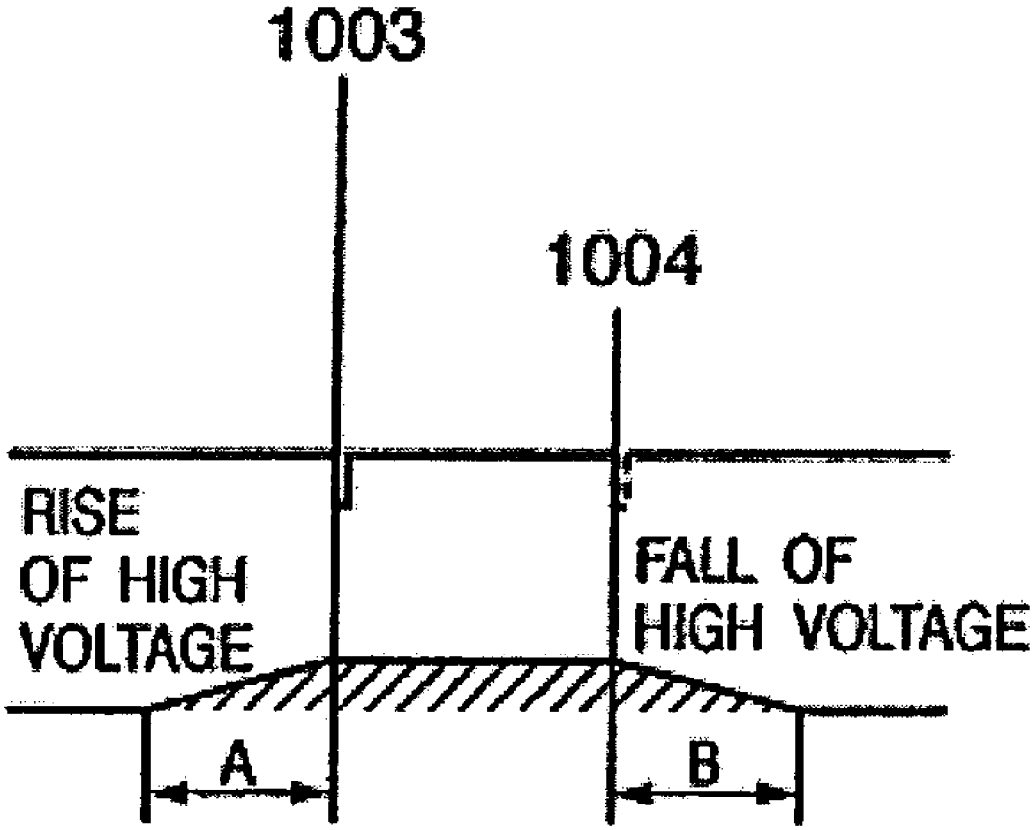
FIG. 10 PRIOR ART
FIG. 10 is a chart for explaining the conventional application time of a high charge AC voltage.

FIG. 9 shows a communication sequence (control of the controller 201) between the controller 201, the discharge option control unit 202, and the engine control unit 203 according to the first embodiment.

The controller 201 transmits print reservation command 1 (901) and print reservation command 2 (902) for two paper sheets to the engine control unit 203, and discharge bin 1 discharge reservation 1 (903) and discharge bin 2 discharge reservation 2 (904) to the discharge option control unit 202. After transmitting discharge bin 2 discharge reservation 2 (904), the controller 201 acquires from the discharge option control unit 202 a time Tt necessary to move the sheet from discharge bin 1 to discharge bin 2 (905).

The controller 201 transmits print start command 1 (906) to the engine control unit 203. The engine control unit 203 starts print operation (outputs /TOP signal 1 (907) for the first paper sheet).

Since a time is taken to switch the discharge bin in print operation on the second paper sheet, the controller 201 sends till a normal print start timing an image formation timing suspend command (908) including a time (to be referred to as a "suspend time" hereinafter) taken to widen the interval between paper sheets. The suspend time added to the image formation timing suspend command by the controller 201 is calculated on the basis of a discharge bin switching time acquired from the discharge option control unit.

If the cause of the delay is not switching of the discharge bin, the delay time can be determined by, e.g., prediction processing by the controller itself. The controller 201 is mainly formed by a processor and can easily perform prediction processing by executing a program of a predetermined sequence. For example, when an image to be printed contains many objects and rendering processing requires a very long time in printing by banding processing, each page may be rendered to prevent data underrun. In this case, a print instruction is issued after image data of one page is generated, and an idle time may occur between pages. To avoid this, the controller 201 estimates a time taken for page rendering on the basis of the type or amount of object or the like, and determines as a delay time a time till the predicted end time of rasterization of a page of interest after the end of printing a page immediately before the page of interest subjected to rasterization of each page. The controller 201 adds the delay time to the image formation timing suspend command, and sends the resultant command to the engine control unit 203.

In this manner, the delay time can be predicted from the cause of the delay, and is determined by a method corresponding to the cause of the delay.

The controller 201 sends a print start command (909) for the second paper sheet till the suspended image formation timing. The engine control unit outputs a/TOP signal (911) at the suspended image formation timing (910) notified by the image formation timing suspend command, and starts image forming operation.

<Control Sequence in Engine Control Unit>

Figure 13:
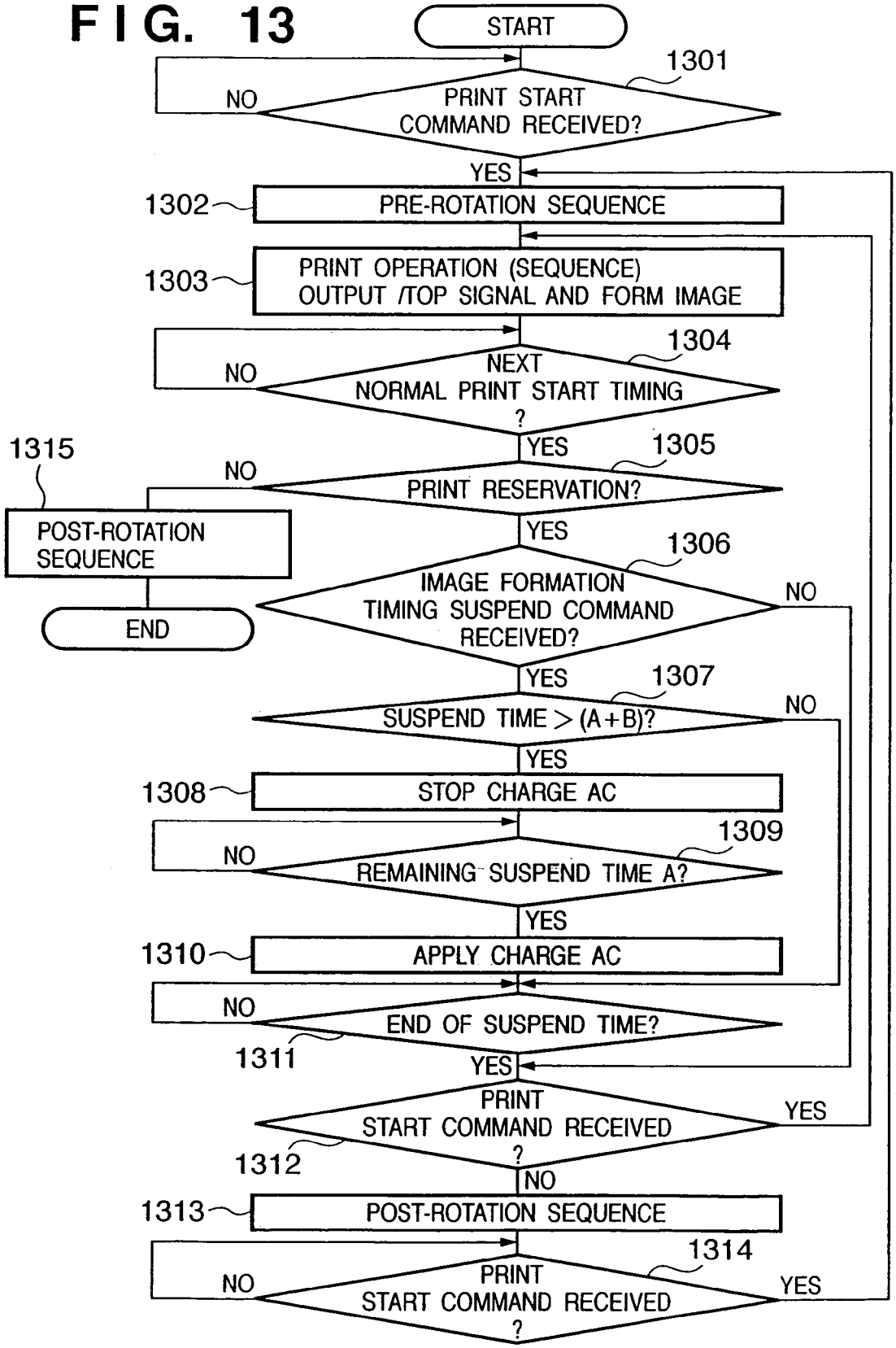
FIG. 13 is a flow chart of an engine control unit according to the first embodiment.

FIG. 13 is a flow chart of the engine control unit 203 according to the first embodiment.

If the engine control unit 203 receives a print reservation command, the engine control unit 203 waits for reception of a print start command (step 1301), and executes the pre-rotation sequence (step 1302). After the end of the pre-rotation sequence, the engine control unit 203 outputs a /TOP signal, and starts print operation in accordance with print operation conditions designated by a print reservation command for the first paper sheet (step 1303).

If the engine control unit 203 has not received the next print reservation command till a normal print start timing, the engine control unit 203 executes postprocessing of print operation and ends print operation (steps 1304, 1305, 1315).

If the engine control unit 203 has received the next print reservation till the normal print start timing of the second paper sheet and has not received any image formation timing suspend command, the engine control unit 203 determines whether it has received a print start command for the print reservation of the second paper sheet. If the engine control unit 203 has received the print start command, the engine control unit 203 outputs a /TOP signal for the second paper sheet and starts image formation (steps 1306, 1312, and 1303). If the engine control unit 203 has not received any print start command, the engine control unit 203 executes the post-rotation sequence and waits for reception of a print start command for the second paper sheet (steps 1313 and 1314).

If the engine control unit 203 has received the next print reservation command and image formation timing suspend command till the normal print start timing of the second paper sheet, the engine control unit 203 branches to two processes in step 1307 depending on the designated suspend time.

(First Processing)

Figure 11:
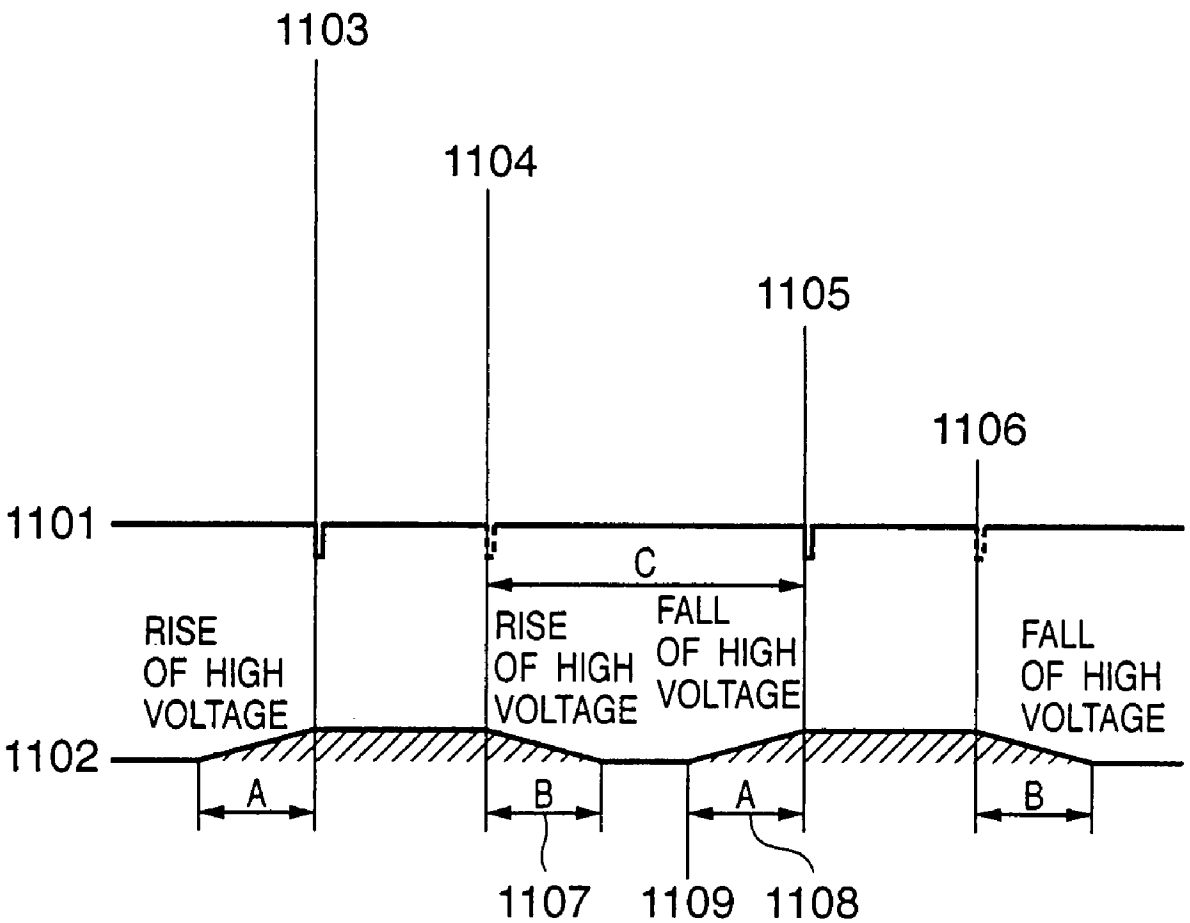
FIG. 11 is a chart for explaining chart 1 of the application time of a high charge AC voltage according to the first, second, and third embodiments.

The first processing is shown in FIG. 11. If a designated suspend time C is longer than the sum of a time B (1107) taken to make a high charge AC voltage fall, and a time A (1108) taken to make the high charge AC voltage rise, the engine control unit 203 makes the high charge AC voltage fall at the normal print start timing (1105) of the second paper sheet (step 1308). The engine control unit 203 applies the high charge AC voltage so as to make the high charge AC voltage rise at the print start timing (1105) of the second paper sheet after the suspend time designated by the image formation timing suspend command (timing 1109 in FIG. 11 and steps 1309 and 1310 in FIG. 13).

If the engine control unit 203 has received a print start command till the print start timing of the second paper sheet that is suspended by the delay time designated by the image formation timing suspend command, the engine control unit 203 outputs a /TOP signal and starts image formation on the second paper sheet (steps 1312 and 1303 in FIG. 13). If the engine control unit 203 has not received any print start command till the print start timing of the second paper sheet that is suspended by the time designated by the image formation timing suspend command, the engine control unit 203 executes the post-rotation sequence and waits for transmission of the print start command for the second paper sheet (steps 1313 and 1314).

(Second Processing)

Figure 12:
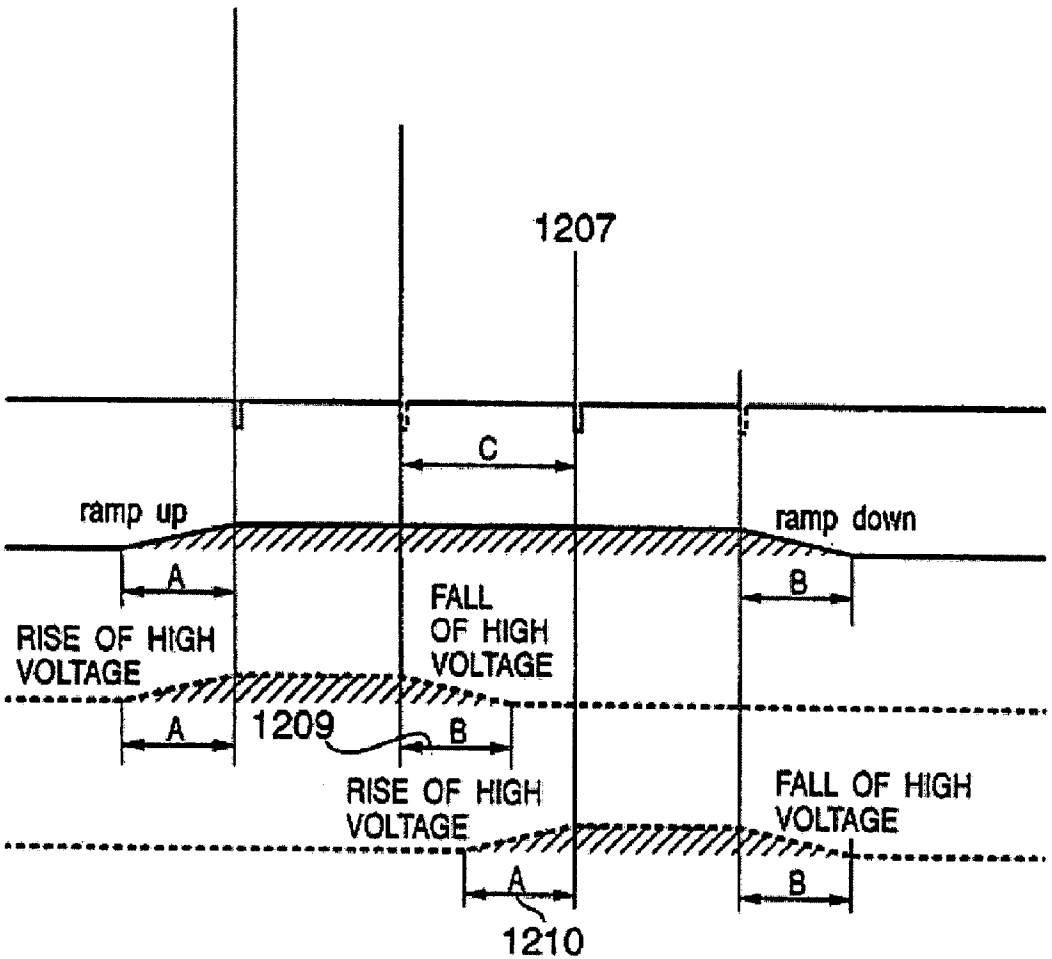
FIG. 12 is a chart for explaining chart 2 of the application time of a high charge AC voltage according to the first, second, and third embodiments.

The second processing is shown in FIG. 12. If the designated suspend time C is shorter than the sum of the time B (1209) taken to make a high charge AC voltage fall, and the time A (1210) taken to make the high charge AC voltage rise, the engine control unit 203 continues application of the high charge AC voltage. If the engine control unit 203 has received a print start command till the print start timing (1207) of the second paper sheet that is suspended by the time designated by the image formation timing suspend command, the engine control unit 203 outputs a /TOP signal and starts print operation on the second paper sheet (steps 1311 and 1312 in FIG. 13).

If the engine control unit 203 has not received any print start command till the print start timing (1207) of the second paper sheet that is suspended by the time designated by the image formation timing suspend command, the engine control unit 203 executes the post-rotation sequence and waits for transmission of the print start command (1313 and 1314).

By the above-described control, even when the interval between the paper sheets of the first and second pages is widened from a normal one by processing of the option control unit such as switching of the discharge bin, charging of the developing drum serving as preprocessing has been performed in synchronism with the print start time of the second page, preventing a wasteful down time. Charging of the drum is temporarily stopped, and starts again. If the interval between paper sheets is larger than the time required to reach a printable state, charging of the drum is temporarily stopped, decreasing the drum degradation rate.

The above-described embodiment can be variously changed on the basis of the gist of the present invention, and various changes should not be excluded from the scope of the invention. For example, the delay time is not always caused by processing of the option control unit, and may also be caused by a rendering delay. Further, what should be stopped owing to a large interval between paper sheets is not limited to charging of the drum. The present invention can be applied to a part whose consumption proceeds immediately when the part is set in a printable standby state, and can prolong the service life of such part.

According to the first embodiment, the controller issues an instruction to the engine control unit so as to immediately start printing without any delay in accordance with the most critical processing in the image forming apparatus. In accordance with this instruction, the engine control unit determines whether to temporarily stop the operation of an expandable, e.g., charging of the drum.

[Second Embodiment]

The second embodiment will describe a case wherein image formation timing information is set for each paper sheet by adding delay time information of the image formation timing of each transfer medium to a print reservation command. In this case, the engine control unit changes control of a high charge AC voltage applied to a photosensitive member in accordance with delay time information designated for each transfer medium.

In the second embodiment, delay time information of the image formation timing of each transfer medium is added together with the print conditions of the transfer medium to a print reservation command. An image forming apparatus (laser beam printer) is identical to that shown in FIGS. 1 and 2, and a description thereof will be omitted.

Figure 14:
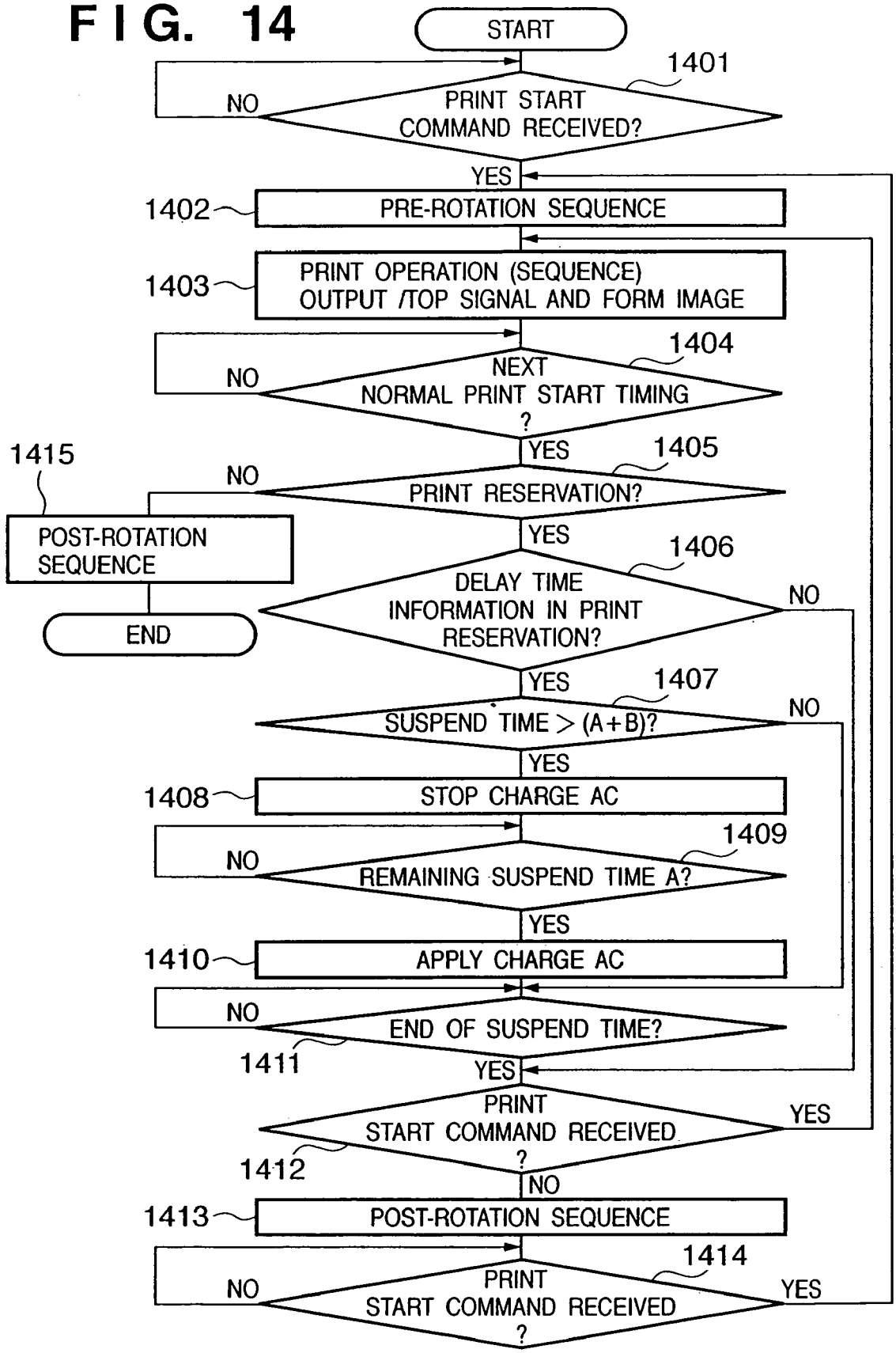
FIG. 14 is a flow chart of an engine control unit according to the second embodiment.

FIG. 14 is a flow chart of an engine control unit 203 according to the second embodiment. If the engine control unit 203 receives a print reservation command, the engine control unit 203 waits for reception of a print start command (step 1401), and executes the pre-rotation sequence (step 1402). After the end of the pre-rotation sequence, the engine control unit 203 outputs a /TOP signal, and starts print operation in accordance with print operation conditions designated by a print reservation command for the first paper sheet (step 1403).

If the engine control unit 203 has not received the next print reservation command till a normal print start timing, the engine control unit 203 3 executes postprocessing of print operation and ends print operation (steps 1404, 1405 and 1415).

If the engine control unit 203 has received the next print reservation till the normal print start timing of the second paper-sheet and the print reservation does not designate the suspend time of the image formation timing, the engine control unit 203 determines whether it has received a print start command for the print reservation of the second paper sheet. If the engine control unit 203 has received the print start command, the engine control unit 203 outputs a /TOP signal for the second paper sheet and starts image formation (steps 1406, 1412, and 1403). If the engine control unit 203 has not received any print start command, the engine control unit 203 executes the post-rotation sequence and waits for reception of a print start command for the second paper sheet (steps 1413 and 1414).

If the engine control unit 203 has received the next print reservation command till the normal print start timing of the second paper sheet and the print reservation command designates the suspend time of the image formation timing, the engine control unit 203 performs either of the following two processes depending on the designated suspend time.

(First Processing)

If the designated suspend time C is longer than the sum of the time B (time 1107 in FIG. 11) taken to make a high charge AC voltage fall, and the time A (time 1108 in FIG. 11) taken to make the high charge AC voltage rise, the engine control unit 203 makes the high charge AC voltage fall at the normal print start timing (timing 1105 in FIG. 11) of the second paper sheet (step 1408). The engine control unit 203 applies the high charge AC voltage so as to make the high charge AC voltage rise at the print start timing (timing 1105 in FIG. 11) of the second paper sheet after the suspend time designated by the print reservation command (timing 1109 in FIG. 11 and steps 1409 and 1410 in FIG. 14). If the engine control unit 203 has received a print start command till the end of the suspend time, the engine control unit 203 outputs a /TOP signal and starts image formation on the second paper sheet (steps 1412 and 1403). If the engine control unit 203 has not received any print start command till the end of the suspend time, the engine control unit 203 executes the post-rotation sequence and waits for transmission of the print start command for the second paper sheet (steps 1413 and 1414).

(Second Processing)

If the designated suspend time C is shorter than the sum of the time B (time 1209 in FIG. 12) taken to make a high charge AC voltage fall, and the time A (time 1210 in FIG. 12) taken to make the high charge AC voltage rise, the engine control unit 203 continues application of the high charge AC voltage. If the engine control unit 203 has received a print start command till the print start timing (timing 1207 in FIG. 12) of the second paper sheet after the suspend time, the engine control unit 203 outputs a /TOP signal and starts print operation on the second paper sheet (steps 1411 and 1412). If the engine control unit 203 has not received any print start command till the end of the suspend time, the engine control unit 203 executes the post-rotation sequence and waits for transmission of the print start command (steps 1413 and 1414).

By the above-described processing, a suspend time can be contained in a print reservation command, achieving the same effects as those of the first embodiment. That is, even when the interval between paper sheets is widened from a normal one by processing of the option control unit such as switching of the discharge bin, a wasteful down time can be prevented, and the drum degradation rate can be decreased.

Figure 6:
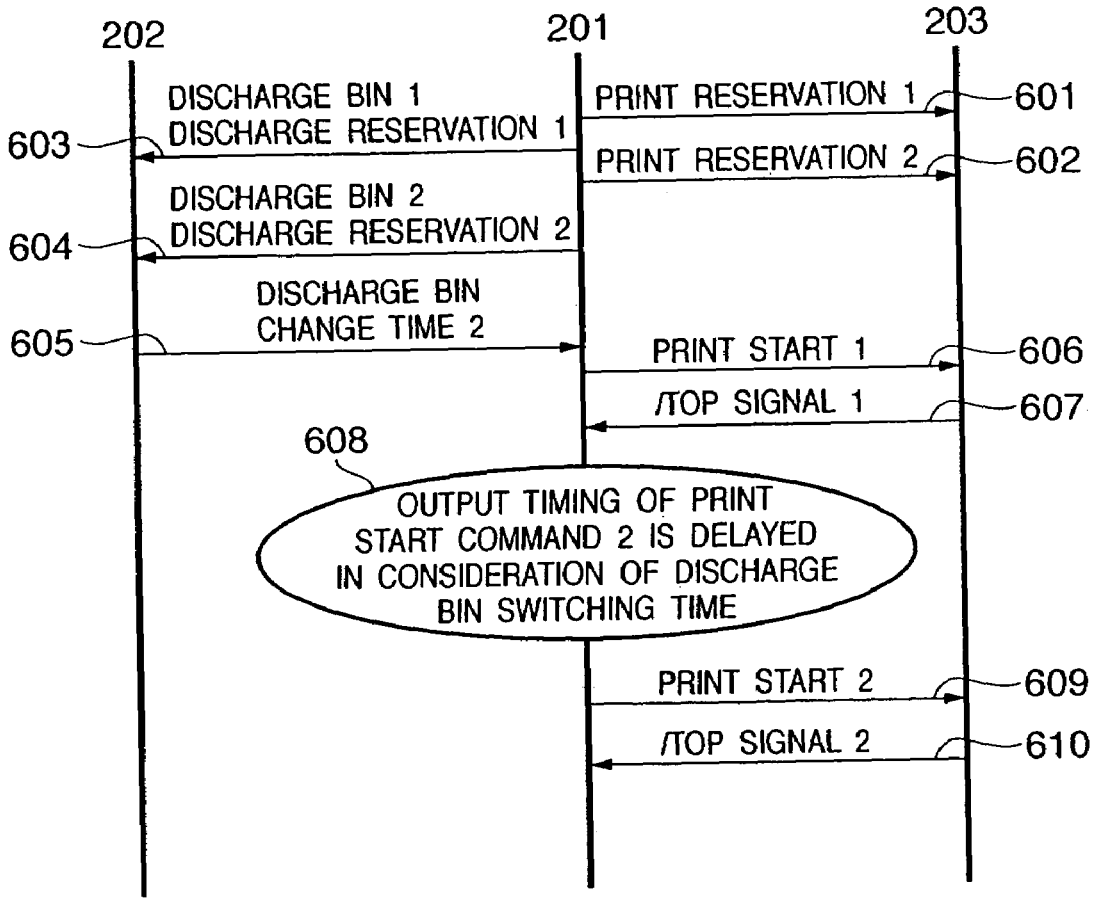
FIG. 6 PRIOR ART
FIG. 6 is a chart showing conventional communication sequence 2.

In the second embodiment, the sequence in FIG. 6 cannot notify the engine control unit in a print reservation of a delay time caused by a change of the discharge bin. Thus, the second embodiment desirably performs processing against a factor which may prolong the interval between paper sheets before a print reservation. Referring to FIG. 6, print reservation commands 601 and 602 are issued upon reception of a discharge bin change time notification 605.

Alternatively, the second embodiment may be combined with the first embodiment. In this case, if a cause which prolongs the interval between paper sheets has been found in issuing a print reservation, a generated suspend time is transmitted to the engine control unit by a print reservation command. If a cause which prolongs the interval between paper sheets has been found upon issuing a print reservation command, the engine control unit is notified of the cause by an image formation timing suspend command.

In this case, the engine control unit performs processing in step 1306 of FIG. 13 immediately before step 1406 of FIG. 14. If the determination result is "NO", the processing branches to step 1406; if "YES", to step 1407. In other words, if delay time information is given by any command, a designated suspend time is tested in step 1407; if no delay time information is given by any command, the processing proceeds on the assumption that no delay exists.

The above-described embodiment can be variously changed on the basis of the gist of the present invention, and various changes should not be excluded from the scope of the invention.

[Third Embodiment]

The third embodiment will describe a case wherein delay time information of the image formation timing of each transfer medium is added to a print start command to be transmitted from the controller to the engine control unit. An image forming apparatus (laser beam printer) is identical to that shown in FIGS. 1 and 2, and a description thereof will be omitted.

In this case, the engine control unit changes control of a high charge AC voltage applied to a photosensitive member in accordance with delay time information of an image formation timing designated by a print start command.

Figure 15:
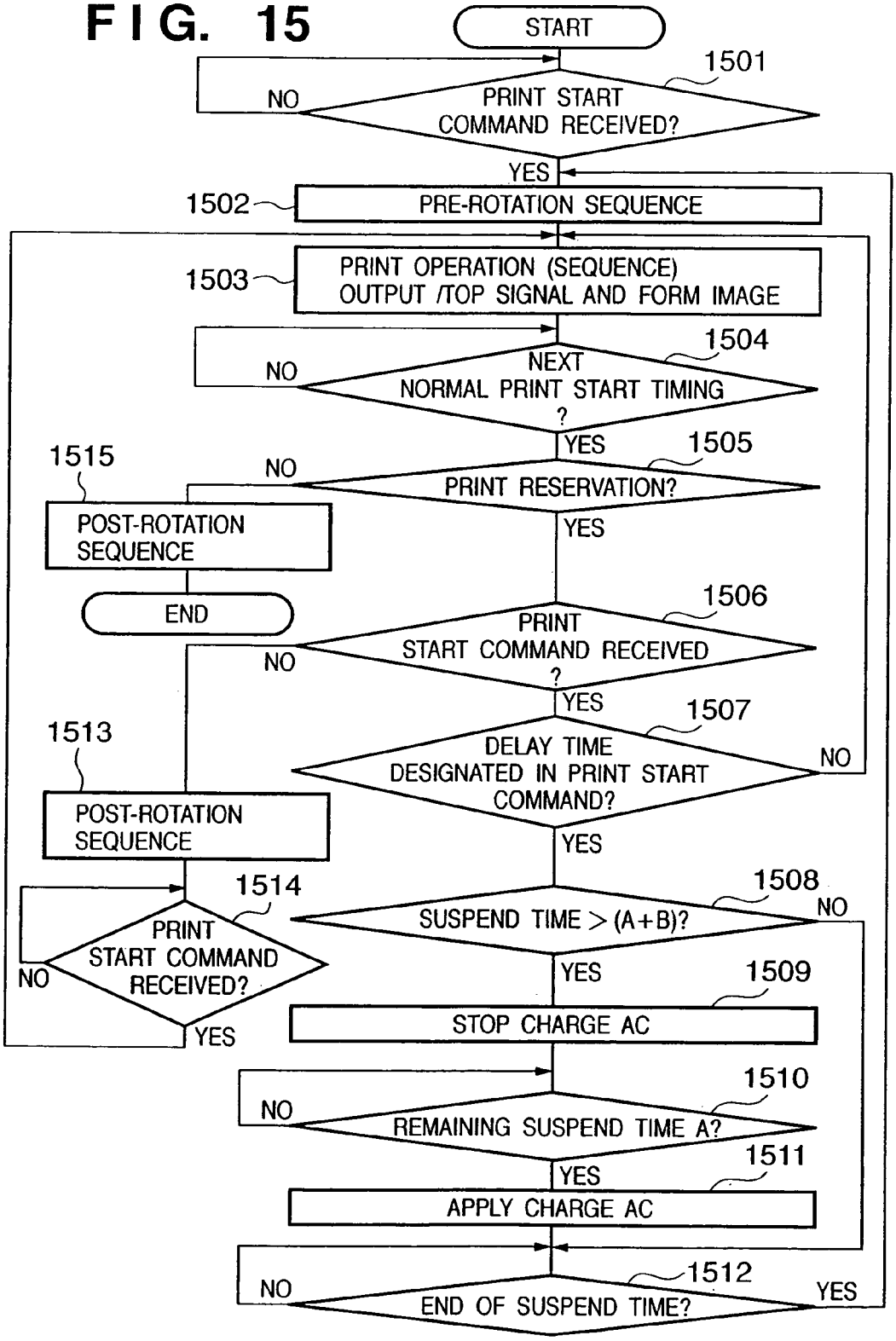
FIG. 15 is a flow chart of an engine control unit according to the third embodiment.

FIG. 15 is a flow chart of an engine control unit 203 according to the third embodiment. If the engine control unit 203 receives a print reservation command, the engine control unit 203 waits for reception of a print start command (step 1501), and executes the pre-rotation sequence (step 1502). After the end of the pre-rotation sequence, the engine control unit 203 outputs a /TOP signal, and starts print operation in accordance with a print reservation command for the first paper sheet (step 1503).

If the engine control unit 203 has not received the next print reservation command till the normal print start timing of the second paper sheet, the engine control unit 203 executes postprocessing of print operation and ends print operation (steps 1504, 1505 and 1515).

If the engine control unit 203 has received the next print reservation till the normal print start timing of the second paper sheet and has not received a print start command for the print reservation, the engine control unit 203 executes the post-rotation sequence and waits for transmission of a print start command for the second paper sheet (steps 1506, 1513 and 1514).

If the engine control unit 203 has received the next print reservation till the normal print start timing of the second paper sheet and a print start command for the print reservation designates the suspend time of the image formation timing (steps 1504, 1505, 1506 and 1507) the engine control unit 203 performs either of the following two processes depending on the designated suspend time.

If the designated suspend time C is longer than the sum of the time B (time 1107 in FIG. 11) taken to make a high charge AC voltage fall, and the time A (time 1108 in FIG. 11) taken to make the high charge AC voltage rise, the engine control unit 203 makes the high charge AC voltage fall at the normal print start timing (timing 1105 in FIG. 11) of the second paper sheet (steps 1508 and 1509).

The engine control unit 203 starts application of the high charge AC voltage (timing 1109 in FIG. 11, steps 1510 and 1511 in FIG. 15) so as to make the high charge AC voltage rise after the lapse of the suspend time designated by the print start command (timing 1105 in FIG. 11). After the high charge AC voltage rises, the engine control unit 203 outputs a /TOP signal and starts image formation on the second paper sheet (steps 1512 and 1503).

If the designated suspend time C is shorter than the sum of the time B (time 1209 in FIG. 12) taken to make a high charge AC voltage fall, and the time A (time 1210 in FIG. 12) taken to make the high charge AC voltage rise, the engine control unit 203 continues application of the high charge AC voltage. After the suspend time, the engine control unit 203 outputs a /TOP signal and starts print operation on the second paper sheet (steps 1512 and 1503).

By the above-described processing, even when the interval between paper sheets is widened from a normal one by processing of the option control unit such as switching of the discharge bin, a wasteful down time can be prevented, and the drum degradation rate can be decreased.

The third embodiment suffices to issue the same commands as conventional ones at the same timings except that the print start command may contain the suspend time. The controller configuration is hardly changed, reducing the labor of development or the like.

In the third embodiment, the print sequence starts upon the lapse of a delay time notified by a print start command. A delay time predicted by the controller may not coincide with an actual delay time. To solve this problem, if a predicted delay is shorter than an actual one, the delay is prolonged by an image formation delay timing command. If a predicted delay is longer, for example, a command for canceling the current delay and immediately starting printing may be issued.

The above-described embodiment can be variously changed on the basis of the gist of the present invention, and various changes should not be excluded from the scope of the invention, similar to the first embodiment.

[Fourth Embodiment]

The fourth embodiment will describe a case wherein image formation timing information is set for each paper sheet by sending an image formation timing suspend command before sending a print reservation command for each paper sheet. In this case, the engine control unit changes control of a high charge AC voltage applied to a photosensitive member in accordance with delay time information designated for each transfer medium.

An image forming apparatus (laser beam printer) is identical to that shown in FIGS. 1 and 2, and a description thereof will be omitted.

Figure 16:
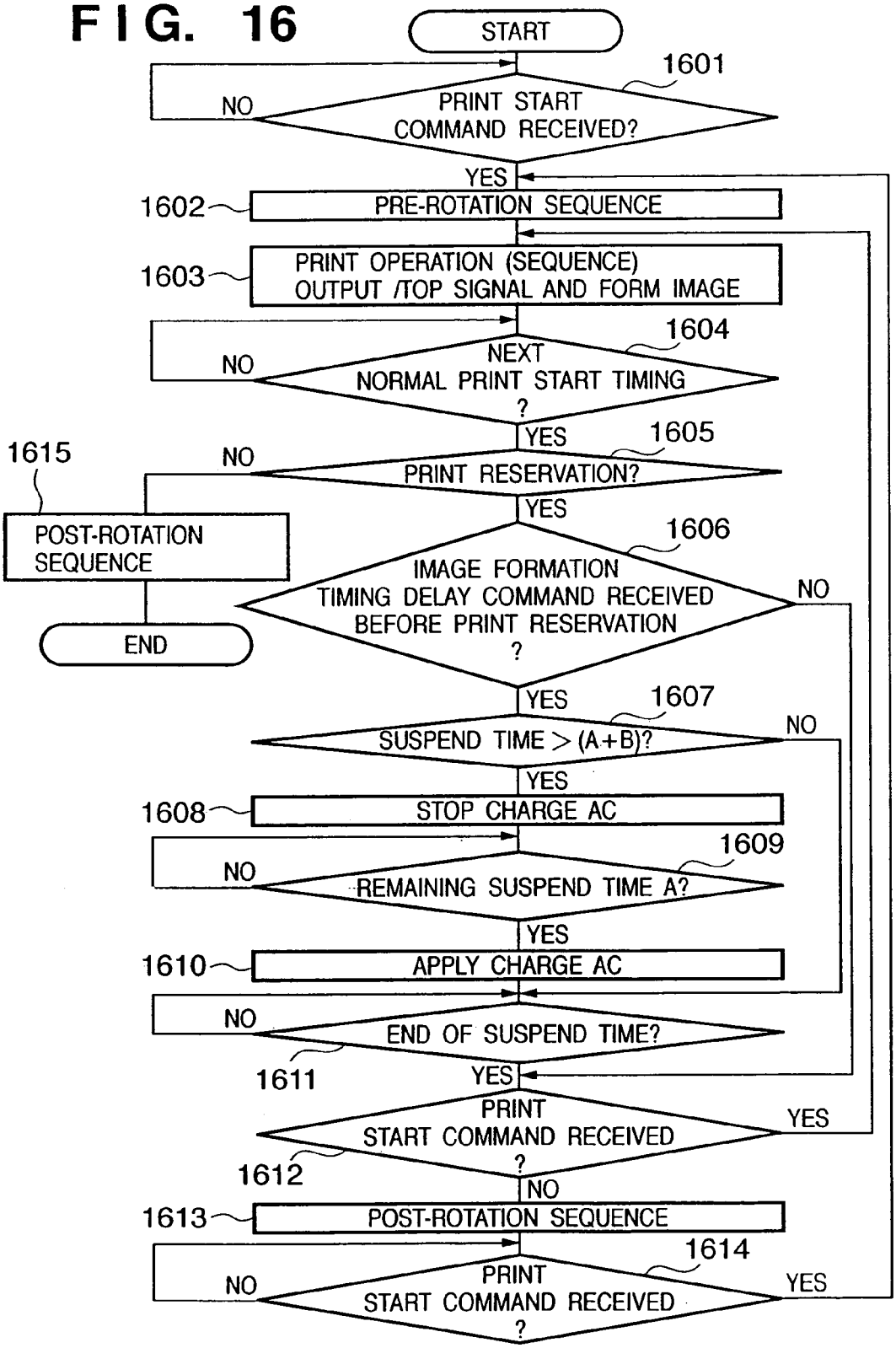
FIG. 16 is a flow chart of an engine control unit according to the fourth embodiment.
Figure 17:
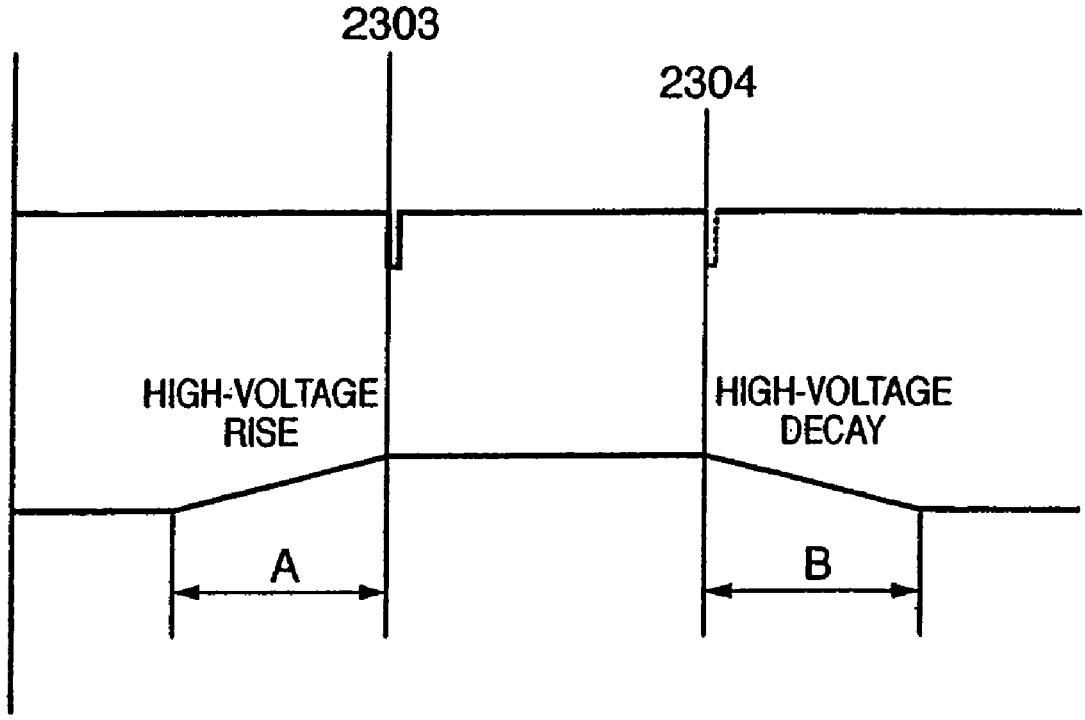
FIG. 17 (PRIOR ART)
FIG. 17 is a diagram useful in describing application time of AC charging high voltage according to the prior art.
Figure 18:
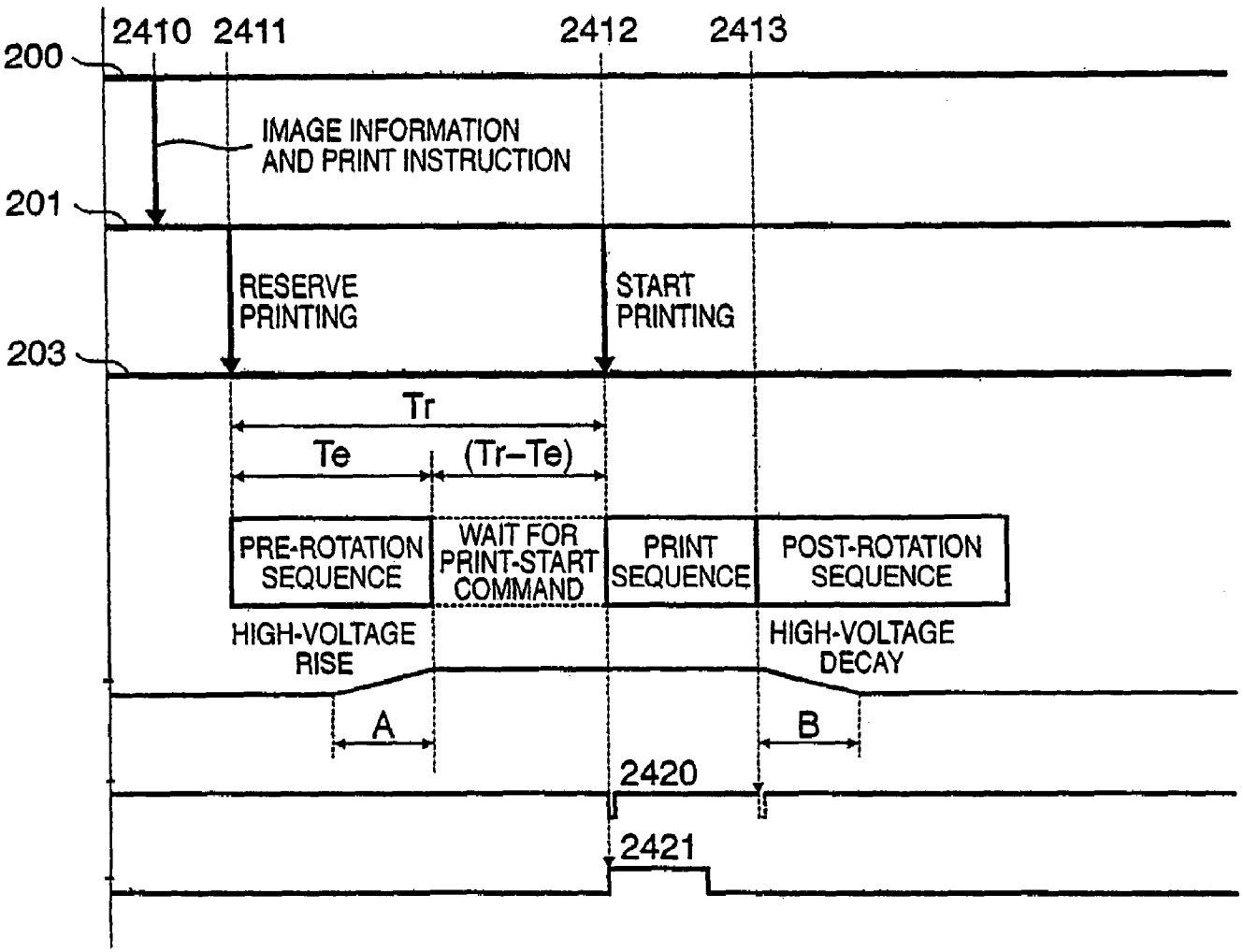
FIG. 18 (PRIOR ART)
FIG. 18 is a sequence chart of an engine control unit according to the prior art.

FIG. 16 is a flow chart of an engine control unit 203 according to the fourth embodiment. If the engine control unit 203 receives a print reservation command, the engine control unit 203 waits for reception of a print start command (step 1601), and executes the pre-rotation sequence (step 1602). After the end of the pre-rotation sequence, the engine control unit 203 outputs a /TOP signal, and starts print operation in accordance with print operation conditions designated by a print reservation command for the first paper sheet (step 1603).

If the engine control unit 203 has not received the next print reservation command till a normal print start timing, the engine control unit 203 executes postprocessing of print operation and ends print operation (steps 1604, 1605 and 1615).

If the engine control unit 203 has received the next print reservation till the normal print start timing of the second paper sheet and has not received an image formation timing suspend command before receiving a print reservation, the engine control unit 203 determines whether it has received a print start command for the print reservation of the second paper sheet. If the engine control unit 203 has received the print start command, the engine control unit 203 outputs a /TOP signal for the second paper sheet and starts image formation (steps 1606, 1612, and 1603). If the engine control unit 203 has not received any print start command, the engine control unit 203 executes the post-rotation sequence and waits for reception of a print start command for the second paper sheet (steps 1613 and 1614).

If the engine control unit 203 has received the next print reservation command till the normal print start timing of the second paper sheet and has received an image formation timing suspend command before receiving a print reservation (steps 1604, 1605, 1606 and 1607), the engine control unit 203 performs either of the following two processes depending on a suspend time designated by the image formation timing suspend command.

If the designated suspend time C is longer than the sum of the time B (time 1107 in FIG. 11) taken to make a high charge AC voltage fall, and the time A {time 1108 in FIG. 11) taken to make the high charge AC voltage rise, the engine control unit 203 makes the high charge AC voltage fall at the normal print start timing (timing 1105 in FIG. 11) of the second paper sheet (steps 1607, 1608). The engine control unit 203 starts application of the high charge AC voltage so as to make the high charge AC voltage rise at the print start timing (timing 1105 in FIG. 11) of the AC charging high voltage being applied and each of the actuators being driven) for transmission of the print-start command. At the moment (2714) that the print-start command is received, the engine control unit 203 transmits the /TOP signal and starts the printing operation (2720, 2721).

(Second Processing)

If the designated suspend time C is shorter than the sum of the time B (time 1209 in FIG. 12) taken to make a high charge AC voltage fall, and the time A (time 1210 in FIG. 12) taken to make the high charge AC voltage rise, the engine control unit 203 continues application of the high charge AC voltage. If the engine control unit 203 has received a print start command till the print start timing (timing 1207 in FIG. 12) of the second paper sheet after the suspend time, the engine control unit 203 outputs a /TOP signal and starts print operation on the second paper sheet (steps 1611 and 1612). If the engine control unit 203 has not received any print start command till the end of the suspend time, the engine control unit 203 executes the post-rotation sequence and waits for transmission of the print start command (steps 1613 and 1614).

By the above-described processing, an image formation timing suspend command can be transmitted before a print reservation command, achieving the same effects as those of the first embodiment. That is, even when the interval between paper sheets is widened from a normal one by processing of the option control unit such as switching of the discharge bin, a wasteful down time can be prevented, and the drum degradation rate can be decreased.

In the fourth embodiment, the sequence in FIG. 6 cannot notify the engine control unit in a print reservation of a delay time caused by a change of the discharge bin. Thus, the fourth embodiment desirably performs processing against a factor which may prolong the interval between paper sheets before a print reservation. Referring to FIG. 6, print reservation commands 601 and 602 are issued upon reception of a discharge bin change time notification 605.

[Fifth Embodiment]

According to the present invention conforming to this embodiment, the controller 201 analyses image information that it has accepted from the host computer 200, and provides a command (referred to below as a "print-start advance-notice command") for notifying the engine control unit 203 of information relating to a time (predicted time) at which it will become possible for a print-start command to be transmitted. Further, the engine control unit 203 compares the predicted time (Tp) reported by the controller 201 with the time (Te) required for the pre-rotation sequence. If the predicted time (Tp) reported by the controller 201 is equal to or shorter than the time (Te) required for the pre-rotation sequence, then the controller 201 starts the pre-rotation sequence at the moment the print-start advance-notice command is received. On the other hand, if the predicted time (Tp) reported by the controller 201 is longer than the time (Te) required for the pre-rotation sequence, then the controller 201 starts the pre-rotation sequence in such a manner that the pre-rotation sequence will end the time Tp after the print-start advance-notice command is received.

If /TOP signal is output from controller 201, the predicted time indicates a time information at which it will become possible for a /TOP signal to be transmitted.

In this embodiment, processing for analysing image information received from the host computer 200 and calculating the predicted time shall be referred to as "image analysis processing" performed by the controller 201, and processing up to the point at which it becomes possible to transmit print data to the engine control unit 203 following reservation of printing start shall be referred to as "print pre-processing" in the description of this embodiment as well because it is similar to the print pre-processing performed by the controller 201 described earlier.

Figure 27:
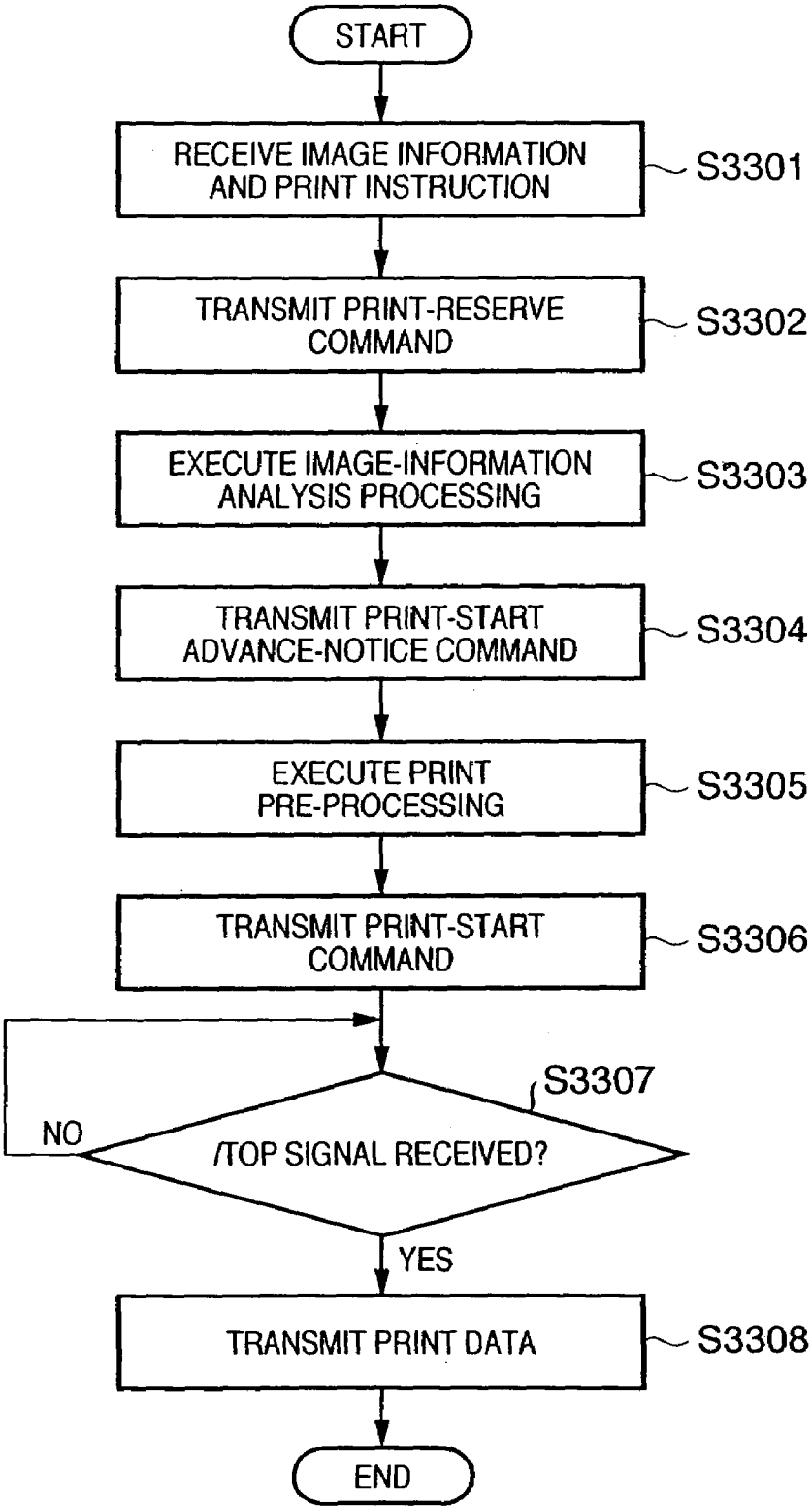
FIG. 27 is a flowchart of processing executed by a control unit conforming to embodiments of the present invention.

FIG. 27 is a flowchart illustrating the gist of processing executed by the controller 201 of this embodiment.

First, image information and a print instruction are received from the host computer 200 (S3301). Furthermore, a print-reserve command is transmitted to the engine control unit 203 in response to receipt of the print instruction (S3302).

Next, the controller 201 applies image analysis processing to the received image information (S3303). Here, on the basis of data size per print-page unit, the controller 201 predicts the time required for print pre-processing with regard to the image data that has been received. The predicted time obtained at S3303 is reported to the engine control unit 203 by utilizing the print-start advance-notice command (S3304). As long as the predicted time is information representing the time believed to be required for print pre-processing in the controller 201, it may take on any form. For example, the predicted time may be a number of clock pulses used to control the operation of the engine control unit. If the engine control unit has a prescribed counter, then the predicted time may be the value recorded by the counter. Print pre-processing is executed when the print-start advance-notice command is transmitted (S3305).

At the conclusion of print pre-processing, the controller 201 transmits the print-start advance-notice command to the engine control unit 203 (S3306). Furthermore, the controller 201 performs monitoring to determine whether the /TOP signal transmitted from the engine control unit 203 has been received (S3307). If the /TOP signal is received, the controller 201 outputs print data to the engine control unit 203 and terminates processing (S3308). If a plurality of sheets are to be printed, then the controller 201 repeats the processing from S3302 onward a number of times equivalent to the number of sheets.

Figure 7:
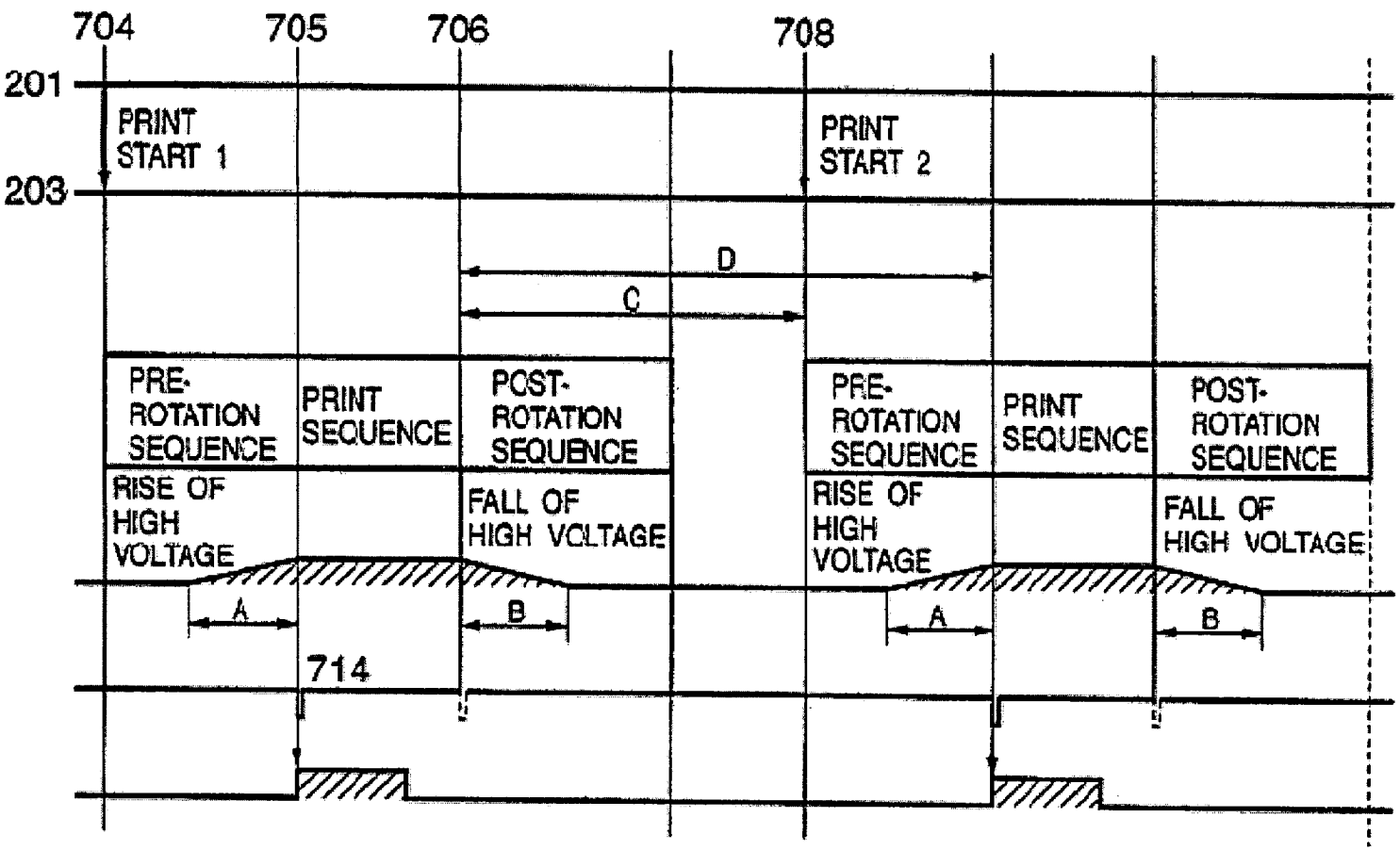
FIG. 7 PRIOR ART
FIG. 7 is a chart showing conventional sequence chart 2 of the engine control unit.
Figure 8:
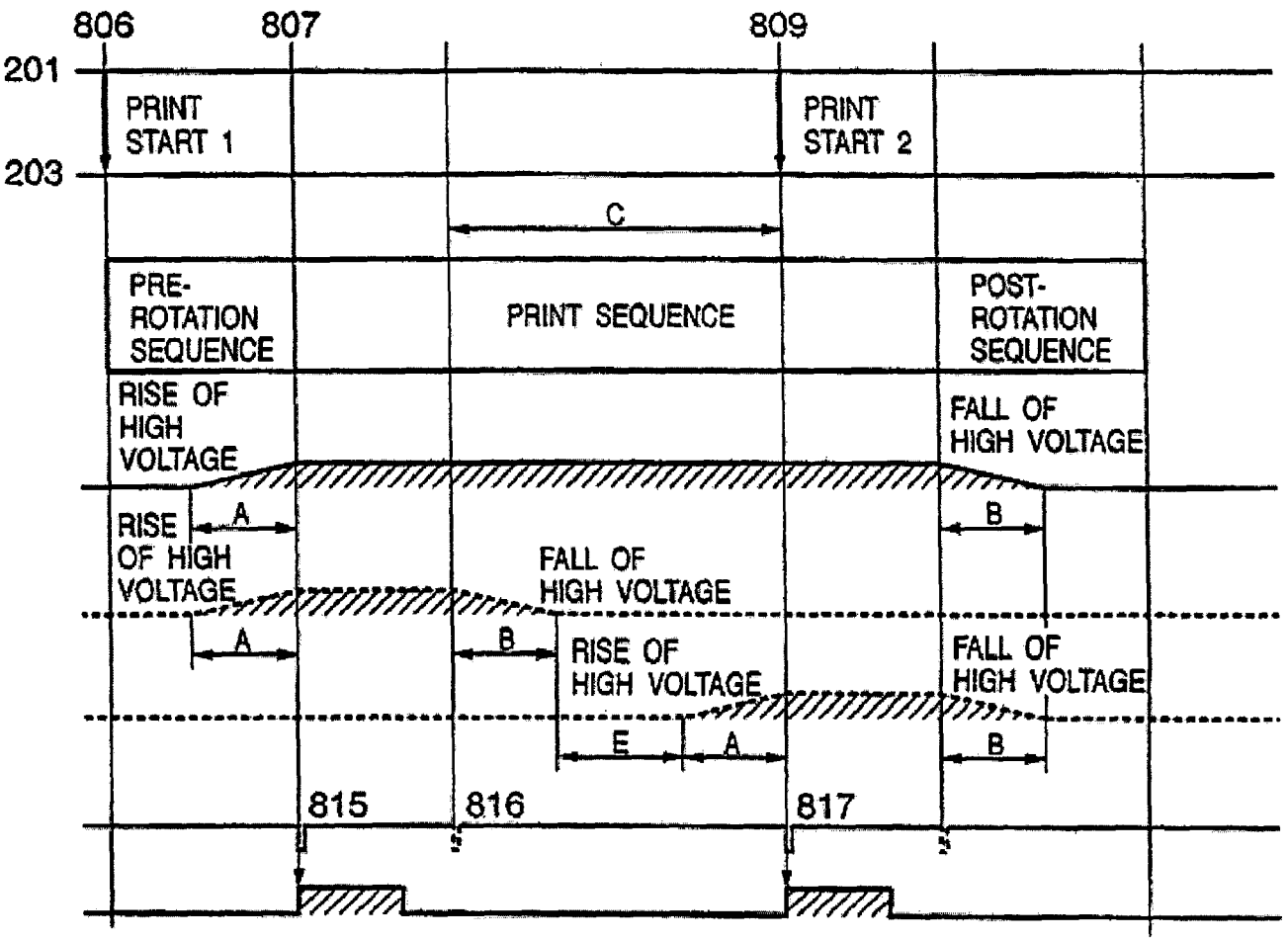
FIG. 8 PRIOR ART
FIG. 8 is a chart showing conventional sequence chart 3 of the engine control unit.

FIGS. 5, 6, and 7 are sequence charts associated with the engine control unit 203 of this embodiment.

Figure 19:
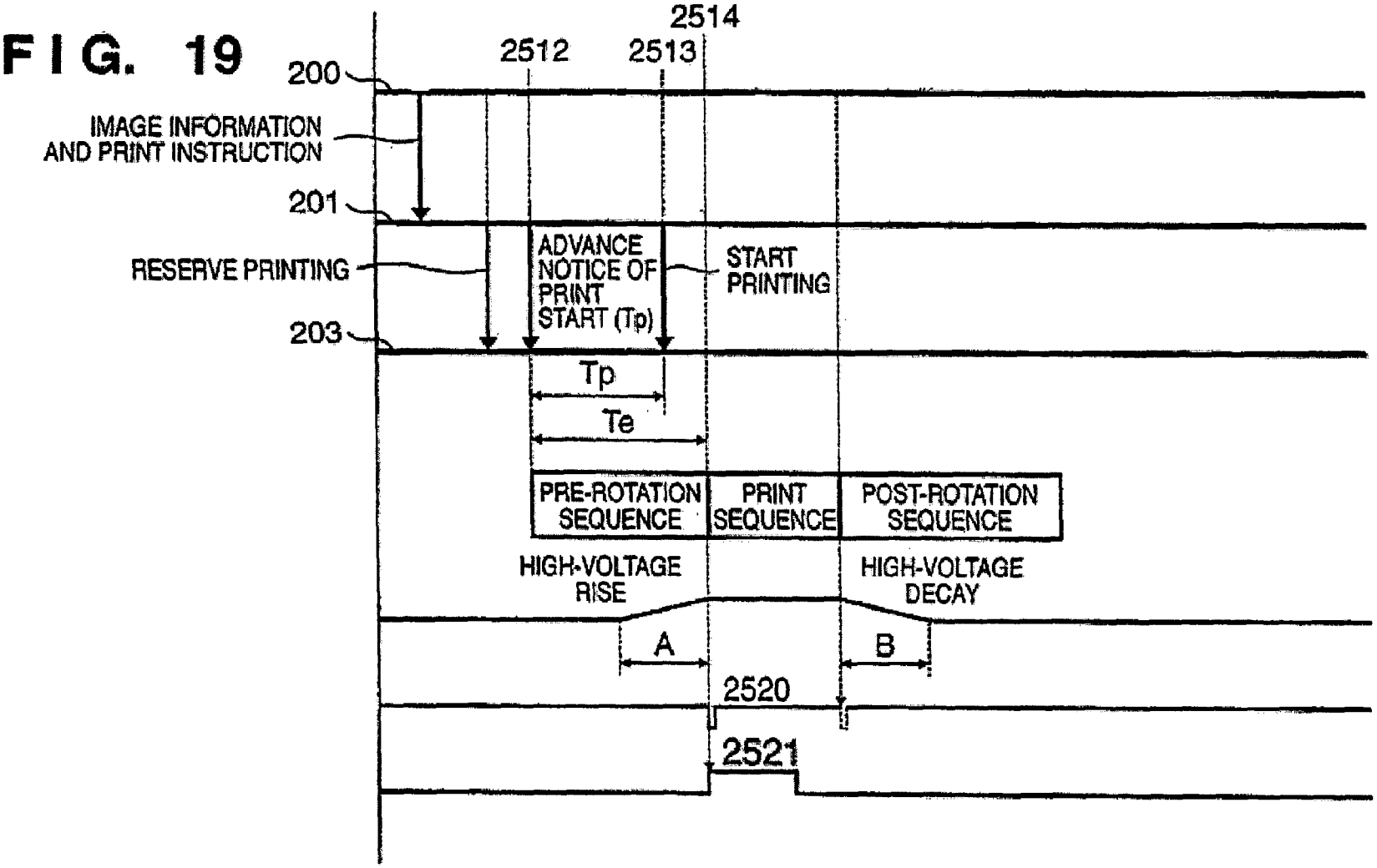
FIG. 19 illustrates an example of a sequence chart conforming to a first embodiment of the present invention.

FIG. 19 is a sequence chart for the case where the predicted time (Tp) specified by the print-start advance-notice command is equal to or shorter than the time (Te) required for the pre-rotation sequence, which is the pre-processing necessary for the engine control unit 203 to perform a printing operation.

Upon receiving the print-start advance-notice command (2512), the engine control unit 203 compares the predicted time (Tp), which has been specified by the print-start advance-notice command, with the time (Te) required for the pre-rotation sequence. If the predicted time (Tp) is equal to or shorter than the time (Te) required for the pre-rotation sequence (i.e., if Tp<Te holds), then the engine control unit 203 starts the pre-rotation sequence (2512) at the moment the print-start advance-notice command is received thereby.

At the conclusion of the pre-rotation sequence (2514), the engine control unit 203 confirms that the print-start command (2513) has been received and transmits the /TOP signal to start the printing operation (2514, 2520, 2521).

Thus, according to the embodiment of the present invention corresponding to FIG. 19, if predicted time reported to the engine control unit is equal to or shorter than the time required for the pre-rotation sequence constituting pre-processing in the engine control unit, the pre-rotation sequence serving as this pre-processing is started by the engine control unit at the moment the engine control unit is notified of the predicted time.

Figure 20:
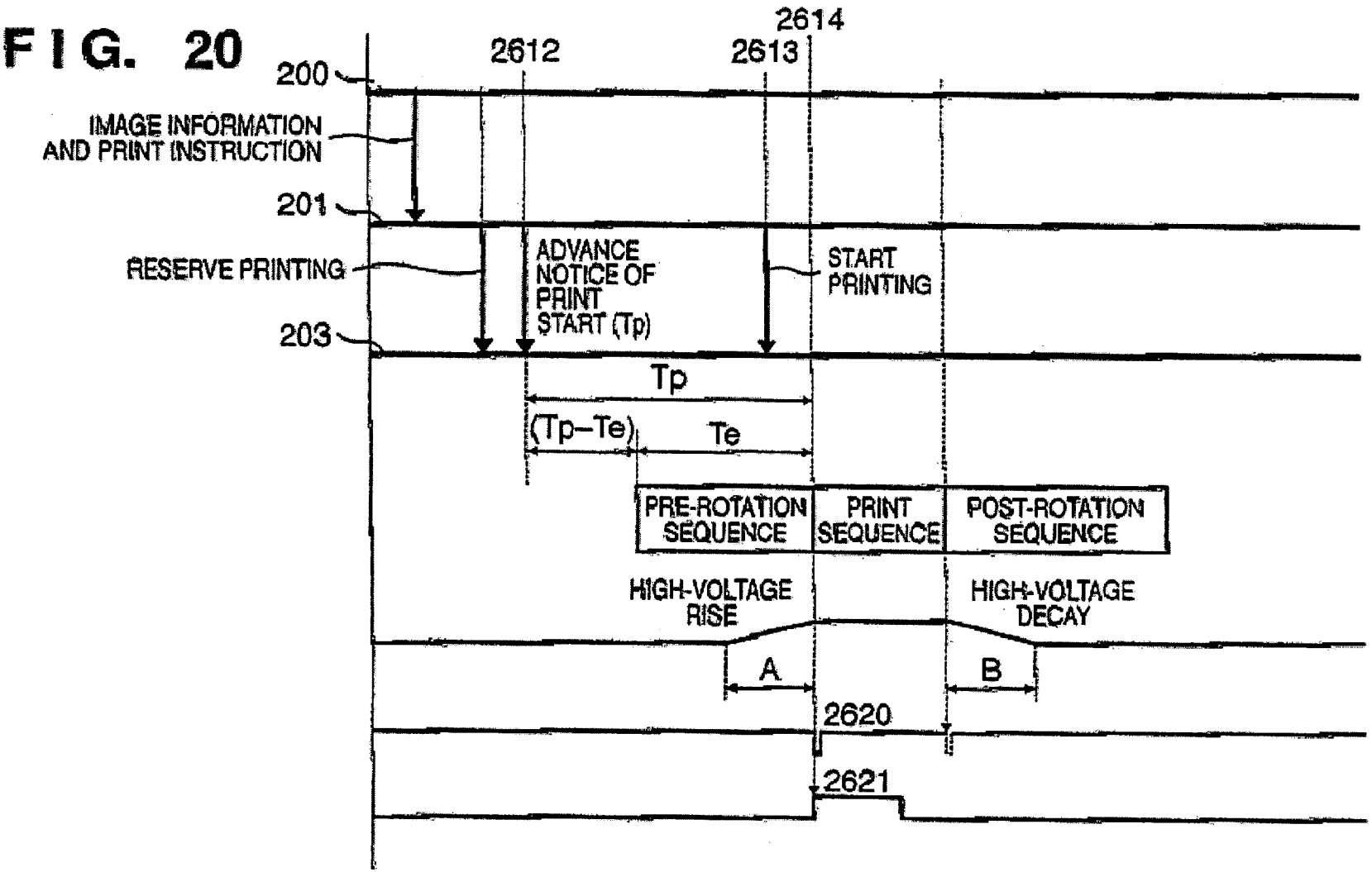
FIG. 20 illustrates an example of a sequence chart conforming to the first embodiment of the present invention.

FIG. 20 is a sequence chart for the case where the predicted time (Tp) specified by the print-start advance-notice command is longer than the time (Te) required for the pre-rotation sequence.

The engine control unit 203 starts the pre-rotation sequence upon passage of time (Tp−Te) from time 2612 in such a manner that the pre-rotation sequence will end at elapse (time 2614) of the predicted time from the timing (2612) at which the print-start advance-notice command is received.

If the print-start command (2613) has been received by the end (2614) of the pre-rotation sequence, then the engine control unit 203 transmits the /TOP signal and starts the printing operation at the moment the pre-rotation sequence ends (2614, 2620, 2621).

Figure 21:
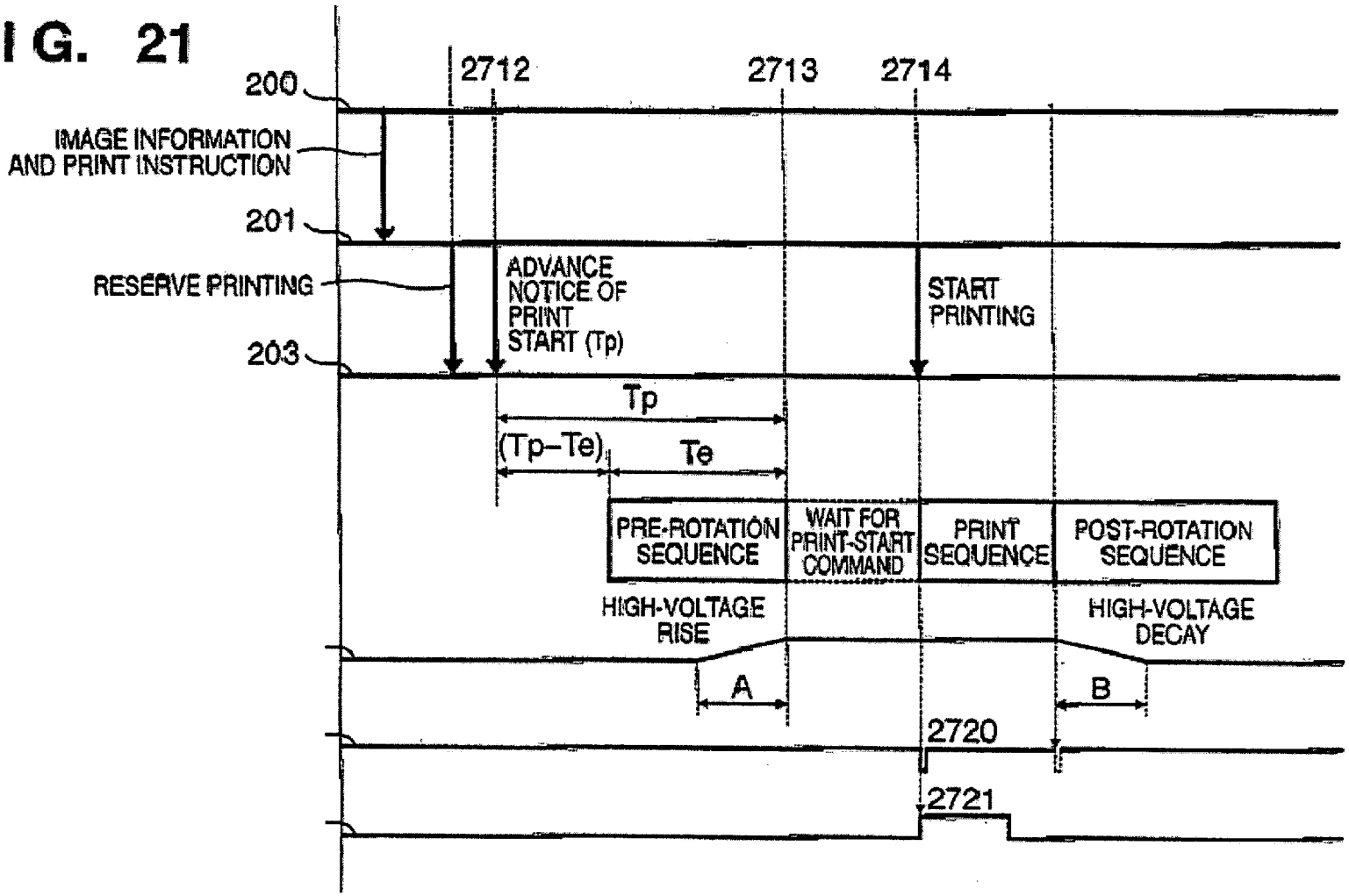
FIG. 21 illustrates an example of a sequence chart conforming to the first embodiment of the present invention.

Thus, according to the embodiment of the present invention corresponding to FIG. 20, if predicted time reported to the engine control unit is longer than the time required for the pre-rotation sequence, the difference between the predicted time and the time required for the pre-rotation sequence is calculated and the pre-rotation sequence by the engine control unit is started upon elapse of time, which is equivalent to the above-mentioned difference, from the moment notification of the predicted time is given. FIG. 21 is a sequence chart for the case where the predicted time (Tp) specified by the print-start advance-notice command is longer than the time (Te) required for the pre-rotation sequence and, moreover, the print-start command is not transmitted despite elapse of the predicted time specified by the print-start advance-notice command.

The engine control unit 203 starts the pre-rotation sequence upon passage of time (Tp−Te) from time 2712 in such a manner that the pre-rotation sequence will end at elapse (time 2713) of the predicted time from the timing (2712) at which the print-start advance-notice command is received.

If the print-start command has not been received by the end (2713) of the pre-rotation sequence, then the engine control unit 203 waits under these conditions (i.e., with the AC charging high voltage being applied and each of the actuators being driven) for transmission of the print-start command. At the moment (2714) that the print-start command is received, the engine control unit 203 transmits the /TOP signal and starts the printing operation (2720, 2721).

Figure 22:
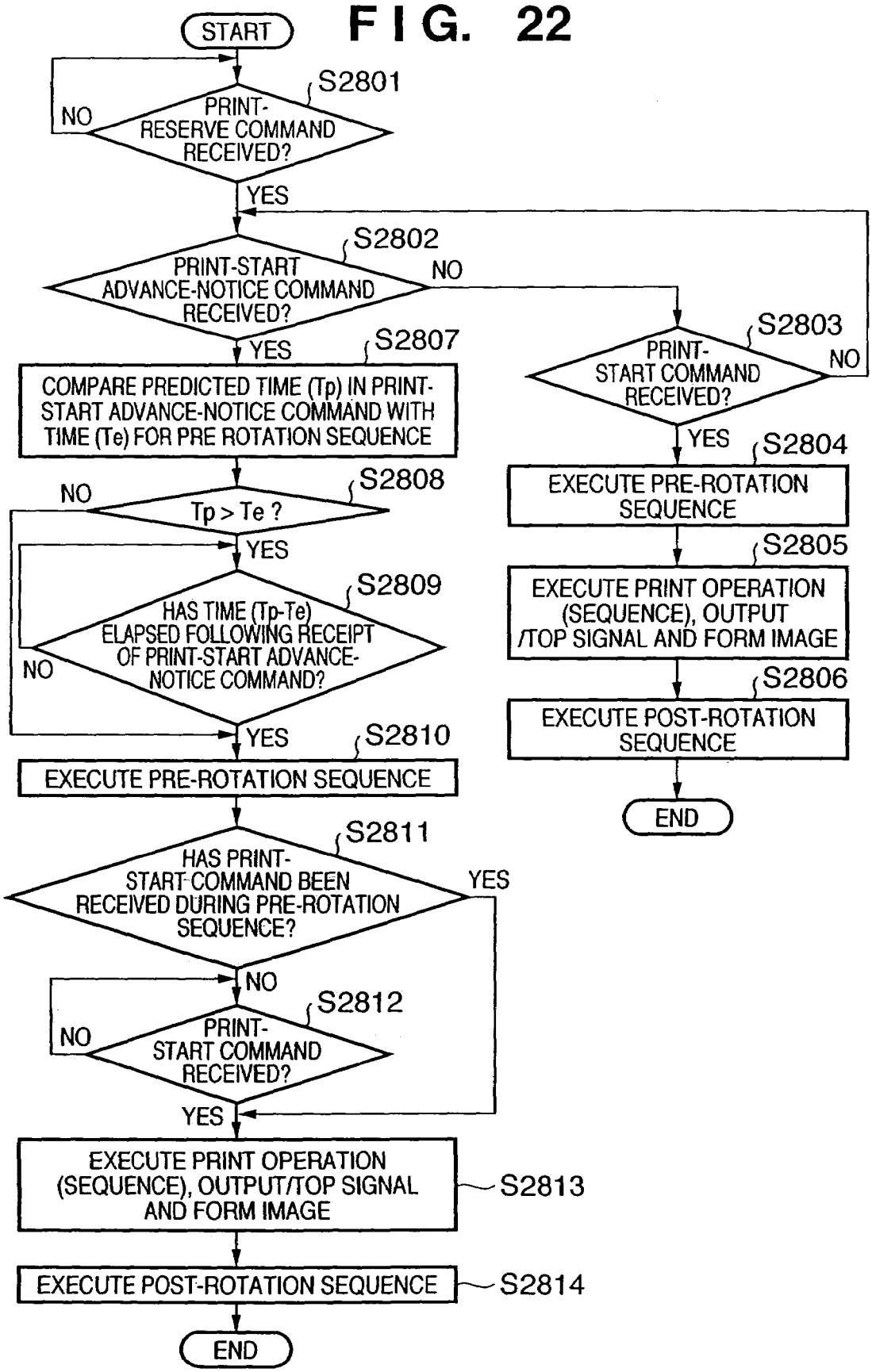
FIG. 22 is a flowchart of processing executed by an engine control unit conforming to the first embodiment of the present invention.

FIG. 22 is a flowchart of processing executed by the engine control unit 203 of this embodiment. Upon receiving the print-reserve command, the engine control unit 203 waits for receipt of the print-start advance-notice command or print-start command (S2801, S2802, S2803). If the print-start command is received under these conditions, the engine control unit 203 starts the pre-rotation sequence and, at the conclusion of the pre-rotation sequence, transmits the /TOP signal to start the printing operation (S2803, S2804, S2805 and S2806).

If the engine control unit 203 receives the print-reserve command in the state in which it is waiting for receipt of the print-start advance-notice command and print-start command, then the engine control unit 203 compares the predicted time (Tp) specified by the print-start advance-notice command and the time (Te) required for the pre-rotation sequence (S2802, S2807).

If the predicted time (Tp) specified by the print-start advance-notice command is equal to or shorter than the time (Te) required for the pre-rotation sequence (i.e., if Tp<Te holds), the engine control unit 203 starts the pre-rotation sequence at the moment the print-start advance-notice command is received (S2808, S2810).

If the predicted time (Tp) specified by the print-start advance-notice command is longer than the time (Te) required for the pre-rotation sequence (i.e., if Tp>Te holds), the engine control unit 203 starts the pre-rotation sequence upon passage of time (Tp−Te) from the moment at which the print-start advance-notice command is received, in such a manner that the pre-rotation sequence will end upon passage of time Tp from the timing at which the print-start advance-notice command is received (S2808, S2809, S2810).

At the conclusion of the pre-rotation sequence, the engine control unit 203 checks to determine whether the print-start command has been received by the end of the pre-rotation sequence and, if the print-start command has been received, outputs the /TOP signal to start the printing operation (S2811, S2813, S2814). If the print-start command has not been received by the end of the pre-rotation sequence, then the engine control unit 203 waits under these conditions for transmission of the print-start command. At the moment the print-start command is received, the engine control unit 203 outputs the /TOP signal to start the printing operation (S2811, S2812, S2813, S2814).

Thus, according to this embodiment, the print-start advance-notice command is provided for reporting, from the controller 201 to the engine control unit 203, predicted time needed until a print-start command can be transmitted. In response, the engine control unit 203 compares the predicted time reported by the controller 201 with the time required for a pre-rotation sequence, which is necessary for the engine control unit 203 to perform a printing operation, and alters the timing at which the pre-rotation sequence is started. As a result, it is possible to achieve an excellent first-printout time irrespective of the load imposed by image information sent from the host computer 200 to the controller 201. In addition, it is possible to slow down the rate of deterioration of consumables, inclusive of photosensitive drums.

The print-start advance-notice command in fifth embodiment may be used as the image formation timing suspend command in first embodiment. It may be preferable to use the predicted time (Tp) designated by the image formation timing suspend command as the suspend time (c) designated by the image formation timing suspend command.

Furthermore, it may be preferable to add information relating to the predicted time (Tp) in the fifth embodiment to print-reserve command to generate a command, just as information relating to the suspend time (c) is added to print-reserve command to generate a command in the second embodiment.

Furthermore, it may be preferable to add information relating to the predicted time (Tp) in the fifth embodiment to print-start command to generate a command, just as information relating to the suspend time (c) is added to print-start command to generate a command in the third embodiment.

Furthermore, it may be preferable to output information relating to predicted time (Tp) from controller 201 to engine control unit 203 before an issue of print-reserve command, just as information relating to the suspend time (c) is output from controller 201 to engine control unit 203 before an issue of print-reverse command.

It should be noted that the above-described embodiment can be modified in various ways based upon the gist of the present invention and that such modifications fall within the scope of the invention.

[Sixth Embodiment]

The first embodiment is such that if the print-start advance-notice command has been transmitted from the controller 201, the timing at which the pre-rotation sequence starts is always decided in accordance with the predicted time (Tp) specified by the print-start advance-notice command.

However, the predicted time that the controller 201 transmits by way of the print-start advance-notice command is merely a prediction, and there are instances where print data can be transmitted to the engine control unit 203 earlier than the predicted time.

In such case the controller 201 transmits the print-start command to the engine control unit 203 at the moment it becomes possible to transmit the print data. However, since the engine control unit 203 decides the start timing of the pre-rotation sequence based upon the predicted time specified by the print-start advance-notice command, the pre-rotation sequence will not commence even if the print-start command is transmitted. This means that needless waiting time may occur, where such waiting time is equivalent to the error in the predicted time calculated by the controller 201.

According to the present invention conforming to the second embodiment, if the predicted time (Tp) that the controller 201 indicates to the engine control unit 203 is longer that the time (Te) required for the pre-rotation sequence (i.e., if Tp>Te holds) and, moreover, the engine control unit 203 has received the print-start command in the period of time from receipt of the print-start advance-notice command to start of the pre-rotation sequence, then the engine control unit 203 executes the pre-rotation sequence at the moment it receives the print-start command.

Figure 23:
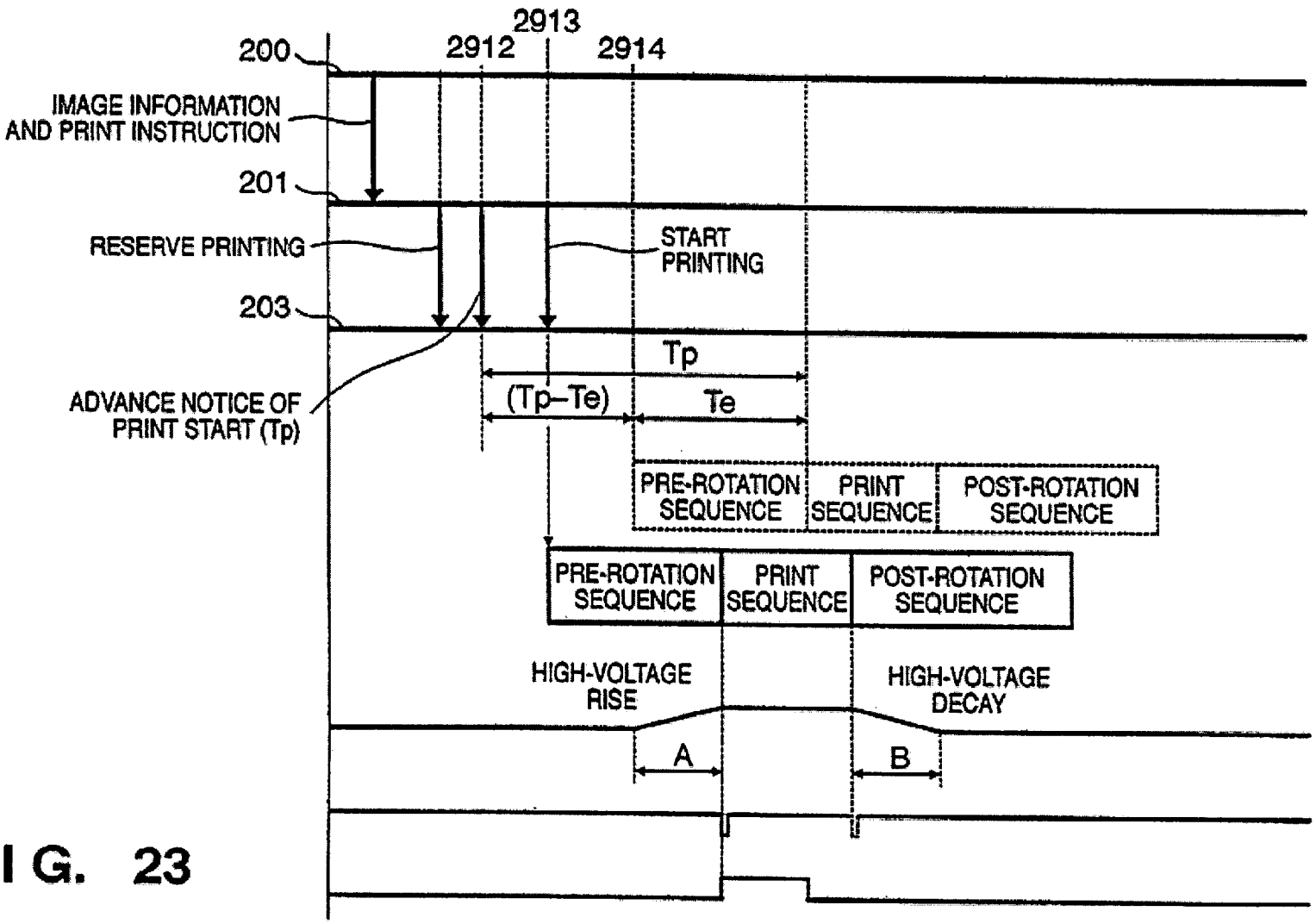
FIG. 23 illustrates an example of a sequence chart conforming to a second embodiment of the present invention.

FIG. 23 is a sequence chart according to this embodiment.

Upon receiving the print-start advance-notice command (2912), the engine control unit 203 waits for the start of the pre-rotation sequence in the period of time (Tp−Te) (2912, 2914).

Ordinarily, the pre-rotation sequence is performed upon passage of time (Tp−Te) from the moment the print-start advance-notice command is received. However, in a case where the print-start command (2913) is received in this waiting interval, the pre-rotation sequence is started at the moment (2913) the print-start command is received.

Thus, according to the embodiment of the present invention shown in FIG. 23, if predicted time reported to the engine control unit is longer than the time required for the pre-rotation sequence, then the difference between the predicted time and the time required for the pre-rotation sequence is calculated. In a case where the engine control unit has been instructed to start a printing operation in advance of elapse of the time equivalent to the calculated difference, the pre-rotation sequence is started by the engine control unit in accordance with the instruction to start the printing operation.

Figure 24:
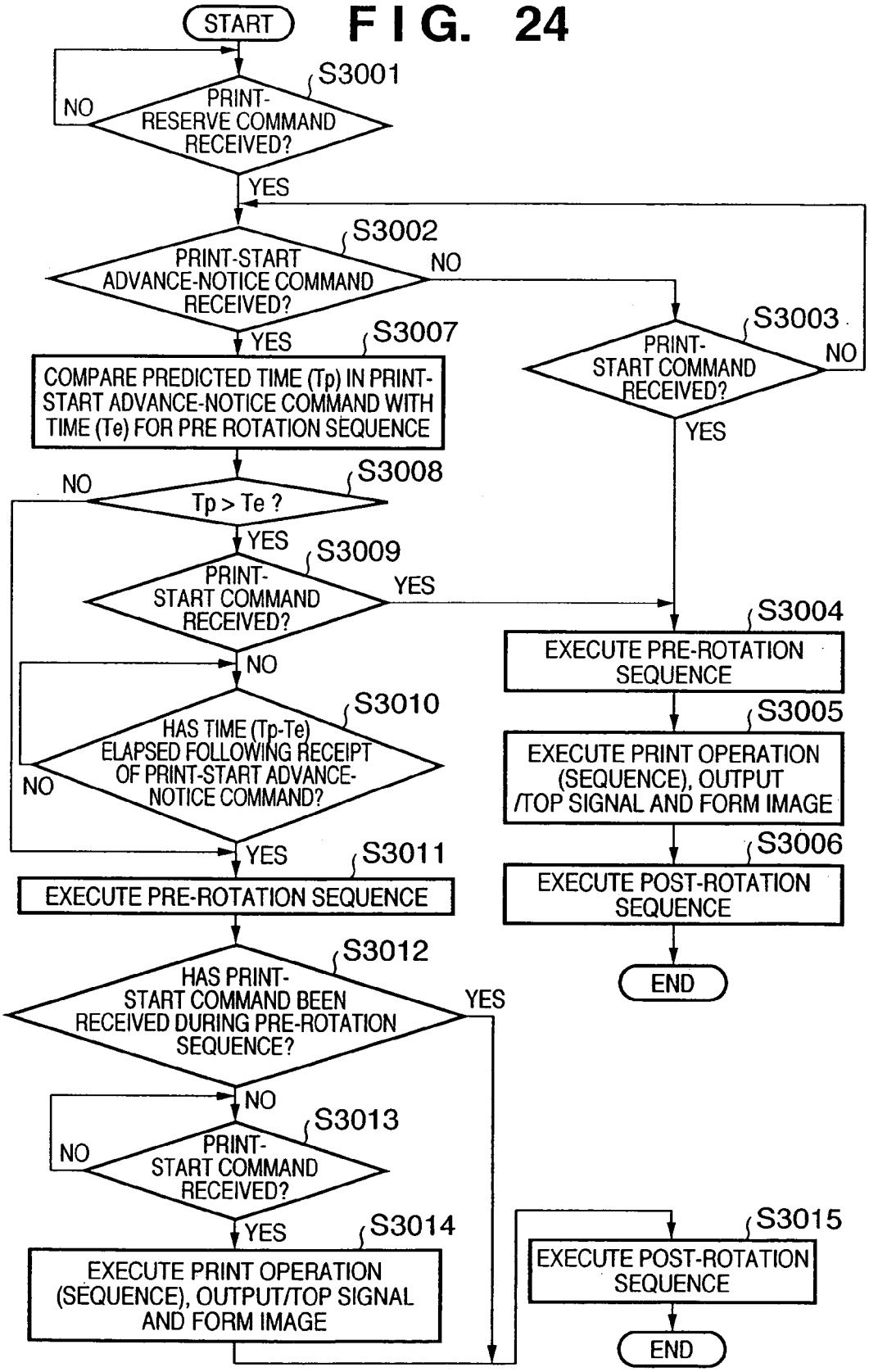
FIG. 24 is a flowchart of processing executed by an engine control unit conforming to the second embodiment of the present invention.

FIG. 24 is a flowchart of this embodiment. Upon receiving the print-reserve command, the engine control unit 203 waits for receipt of the print-start advance-notice command or print-start command (S3001, S3002, S3003). If the print-start command is received under these conditions, the engine control unit 203 starts the pre-rotation sequence and, at the conclusion of the pre-rotation sequence, transmits the /TOP signal to start the printing operation (S3003, S3004, S3005, S3006).

If the engine control unit 203 receives the print-reserve command in the state in which it is waiting for receipt of the print-start advance-notice command or print-start command, then the engine control unit 203 compares the predicted time (Tp) specified by the print-start advance-notice command and the time (Te) required for the pre-rotation sequence (S3002, S3007).

If the predicted time (Tp) specified by the print-start advance-notice command is equal to or shorter than the time (Te) required for the pre-rotation sequence (i.e., if Tp<Te holds), the engine control unit 203 starts the pre-rotation sequence (S3008, S3011).

If the predicted time (Tp) specified by the print-start advance-notice command is longer than the time (Te) required for the pre-rotation sequence (i.e., if Tp>Te holds), the engine control unit 203 waits for start of the pre-rotation sequence in the time period (Tp−Te) (S3010). However, if the print-start command is received in this waiting time period, then the engine control unit 203 starts the pre-rotation sequence simultaneous with receipt of the print-start command (S3009, S3004).

If the print-start command has not been received in the period in which start of the pre-rotation sequence is being awaited, then the engine control unit 203 starts the pre-rotation sequence upon elapse of time (Tp−Te) from the moment the print-start advance-notice command is received (S3010, S3011). The process executed in steps 3012 to 3015 corresponds to the process executed in steps 2811 to 2814 in FIG. 22.

Thus, according to the second embodiment, control can be exercised in such a manner that the pre-rotation sequence is started adaptively even in a case where it becomes possible for the controller 201 to transmit print data to the engine control unit 203 earlier than the predicted time specified by the print-start advance-notice command.

It should be noted that the above-described embodiment can be modified in various ways based upon the gist of the present invention and that such modifications fall within the scope of the invention.

[Seventh Embodiment]

The first embodiment is such that if the engine control unit 203 has not received the print-start command by the time the pre-rotation sequence ends, the engine control unit 203 waits for transmission of the print-start signal in the state prevailing at conclusion of the pre-rotation sequence (i.e., the state in which printing by the engine control unit is possible).

However, in a case where the state prevailing at conclusion of the pre-rotation sequence continues up to transmission of the print-start command, the rate of deterioration of consumables may rise. The longer the above-mentioned state continues, the higher the rate at which consumables may deteriorate.

The present invention conforming to the third embodiment relates to a method so adapted that even in a case where the print-start command is not received by the end of the pre-rotation sequence, there is no increase in the rate of deterioration of consumables, particularly photosensitive drums.

More specifically, in a case where the engine control unit 203 has not received the print-start command by the end of the pre-rotation sequence, application of the AC charging high voltage is halted and then is re-applied when the print-start command is received.

Figure 25:
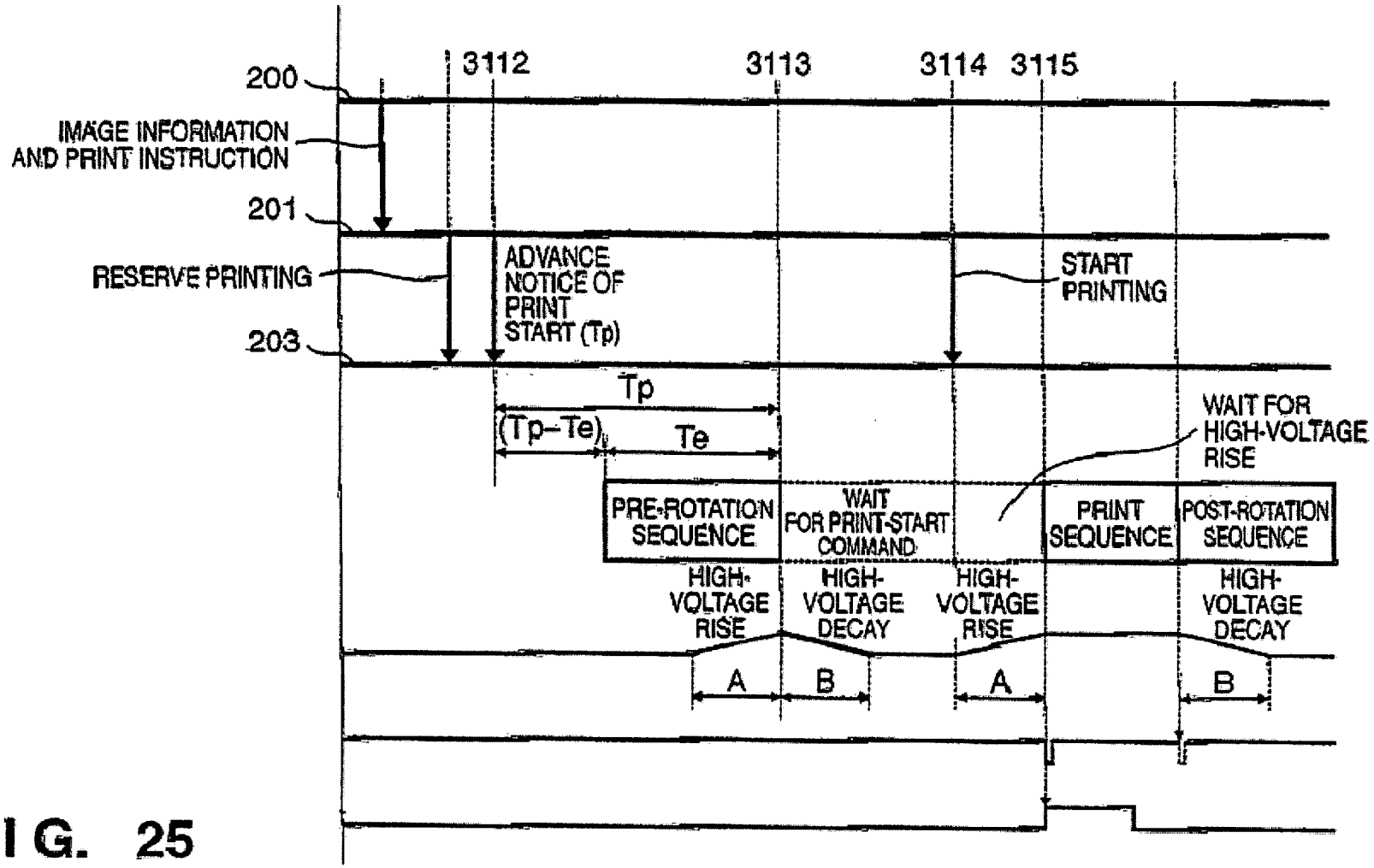
FIG. 25 illustrates an example of a sequence chart conforming to a third embodiment of the invention.

FIG. 25 is a sequence chart according to this embodiment.

In a manner similar to that of FIG. 20, the engine control unit 203 starts the pre-rotation sequence upon passage of time (Tp−Te) from time 3112 in such a manner that the pre-rotation sequence will end at elapse (time 3113) of the predicted time (Tp) from the timing (3112) at which the print-start advance-notice command is received.

If the print-start command has not been received by the end (3113) of the pre-rotation sequence, then the engine control unit 203 halts the application of the AC charging high voltage until the print-start command is received.

If the engine control unit 203 receives the print command while it is waiting for the print-start command, the engine control unit 203 resumes application of the AC charging high voltage and, at the moment the AC charging high voltage rises to the proper level, outputs the /TOP signal to start the printing operation (3114, 3115).

Thus, according to the embodiment of the present invention shown in FIG. 26, the voltage impressed upon a photosensitive body serving as image forming means is changed by the engine control unit in a case where the engine control unit has not been commanded to start the printing operation by the time the predicted time reported to the engine control unit elapses.

FIG. 26 is a flowchart according to the third embodiment. Upon receiving the print-reserve command, the engine control unit 203 waits for receipt of the print-start advance-notice command or print-start command (S3201, S3202, S3203). If the print-start command is received under these conditions, the engine control unit 203 starts the pre-rotation sequence and, at the conclusion of the pre-rotation sequence, transmits the /TOP signal to start the printing operation (S3203, S3204, S3205, S3206).

If the engine control unit 203 receives the print-reserve command in the state in which it is waiting for receipt of the print-start advance-notice command or print-start command, then the engine control unit 203 compares the predicted time (Tp) specified by the print-start advance-notice command and the time (Te) required for the pre-rotation sequence (S3202, S3207).

If the predicted time (Tp) specified by the print-start advance-notice command is longer than the time (Te) required for the pre-rotation sequence (i.e., if Tp>Te holds), the engine control unit 203 waits for start of the pre-rotation sequence in the time period (Tp−Te) (S3210). However, if the print-start command is received from the controller 201 in this waiting time period, then the engine control unit 203 starts the pre-rotation sequence at receipt of the print-start command (S3209, S3204).

If the predicted time (Tp) specified by the print-start advance-notice command is equal to or shorter than the time (Te) required for the pre-rotation sequence (i.e., if Tp<Te holds), the engine control unit 203 starts the pre-rotation sequence at the moment the print-start advance-notice command is received (S3208, S3211).

When the pre-rotation sequence ends, the engine control unit 203 checks to determine whether the print-start command has been received by the end of the pre-rotation sequence. If the print-start command has been received, then the engine control unit 203 outputs the /TOP signal to start the printing operation (S3212, S3216, S3217). If the print-start command has not been received, then the engine control unit 203 halts application of the AC charging high voltage and awaits receipt of the print-start command (S3213, S3214, S3215).

Upon receiving the print-start command while waiting for the print-start command, the engine control unit 203 resumes application of the AC charging high voltage and, at the moment the AC charging high voltage rises to its proper level, outputs the /TOP signal and starts the printing operation (S3214, S3215, S3216, S3217).

Thus, according to this embodiment, application of the AC charging high voltage is halted in a case where the engine control unit 203 has not received the print-start command by the time the pre-rotation sequence ends. When the print-start command is received, the engine control unit 203 resumes application of the AC charging high voltage, thereby making it possible to slow down the rate at which consumables deteriorate.

Further, this embodiment has been described in connection with AC charging high voltage. However, the rate at which consumables deteriorate can be slowed down by exercising similar control also in a situation where there is the likelihood that the rate at which consumables deteriorate will be hastened by application of high voltage other than a charging AC voltage or by driving of various actuators (i.e., by executing control in such a manner that the engine control unit alters the driving conditions of actuators necessary for the printing operation in a case where start of the printing operation has not been commanded by the time the predicted time reported to the engine control unit elapses).

It should be noted that the above-described embodiment can be modified in various ways based upon the gist of the present invention and that such modifications fall within the scope of the invention.

Thus, in accordance with the present invention as described above, an excellent first-printout time is realized irrespective of the time necessary for print pre-processing in a control unit. In addition, it is possible to slow down deterioration rate of consumables, especially photosensitive drums.

The above-described embodiment can be variously changed on the basis of the gist of the present invention, and various changes should not be excluded from the scope of the invention.

The present invention may be applied to a system including a plurality of devices (e.g., a host computer, interface device, reader, and printer) or an apparatus (e.g., a copying machine or facsimile apparatus) formed from a single device.

The object of the present invention is also achieved when a storage medium (or recording medium) which stores software program codes for realizing the functions of the above-described embodiments is supplied to a system or apparatus, and the computer (or the CPU or MPU) of the system or apparatus reads out and executes the program codes stored in the storage medium.

In this case, the program codes read out from the storage medium realize the functions of the above-described embodiments. The program codes and the storage medium which stores the program codes constitute the present invention.

The functions of the above-described embodiments are realized when the computer executes the readout program codes. Also, the functions of the above-described embodiments are realized when an OS (Operating System) or the like running on the computer performs part or all of actual processing on the basis of the instructions of the program codes.

Furthermore, the functions of the above-described embodiments are realized when the program codes read out from the storage medium are written in the memory of a function expansion card inserted into the computer or the memory of a function expansion unit connected to the computer, and the CPU of the function expansion card or function expansion unit performs part or all of actual processing on the basis of the instructions of the program codes.

As has been described above, the present invention can prevent any wasteful down time and decrease the degradation rate of a part such as a drum even when continuous printing fails and the interval between paper sheets is widened from a normal one in processing of an option control unit such as switching of a discharge bin, or image rasterizing processing of a controller.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus comprising:

an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and a transferring portion for transferring the developed image onto a recording medium;

a receiving unit which receives time information on a time required to start image formation of a second page subsequent to a first page;

a control unit which controls said image forming unit; and an image processing unit which processes image information from an external device, wherein said control unit determines whether to continue or to temporarily stop an application of the AC voltage to the image carrier between the first and second pages of image formations in accordance with the time information, wherein said image forming unit forms on a recording medium an image corresponding to the image information processed by said image processing unit, and wherein the time information is based on a time necessary to process image information of the second page by said image processing unit.

2. An image forming apparatus according to claim 1, wherein said control unit determines to temporarily stop the application of the AC voltage to the image carrier when the period to a start of image formation of the second page is longer than a predetermined period, and to continue the application of the AC voltage to the image carrier when the period to a start of image formation of the second page is shorter than a predetermined period.

3. An image forming apparatus according to claim 1, wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page.

4. An image forming apparatus comprising:

an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and a transferring portion for transferring the developed image onto a recording medium;

a receiving unit which receives time information on a time required to start image formation of a second page subsequent to a first page:

a control unit which controls said image forming unit; and an image processing unit which processes image information from an external device, and transmits image formation start instructions for the first and second pages to said receiving unit, wherein said control unit determines whether to continue or to temporarily stop an application of the AC voltage to the image carrier between the first and second pages of image formations in accordance with the time information, and wherein said image processing unit transmits the time information to said receiving unit after transmitting the image formation start instruction for the first page.

5. An image forming apparatus according to claim 4, wherein said control unit determines to temporarily stop the application of the AC voltage to the image carrier when the period to a start of image formation of the second page is longer than a predetermined period, and to continue the application of the AC voltage to the image carrier when the period to a start of image formation of the second page is shorter than a predetermined period.

6. An image forming apparatus according to claim 4, wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page.

7. An image forming apparatus comprising:

an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and a transferring portion for transferring the developed image onto a recording medium;

a receiving unit which receives time information on a time required to start image formation of a second page subsequent to a first page;

a control unit which controls said image forming unit; and an image processing unit which processes image information from an external device, wherein said control unit determines whether to continue or to temporarily stop an application of the AC voltage to the image carrier between the first and second pages of image formations in accordance with the time information, wherein said image processing unit transmits information regarding image formation conditions for the first and second pages to said receiving unit, and wherein the information regarding the image formation condition for the second page includes the time information.

8. An image forming apparatus according to claim 7, wherein said control unit determines to temporarily stop the application of the AC voltage to the image carrier when the period to a start of image formation of the second page is longer than a predetermined period, and to continue the application of the AC voltage to the image carrier when the period to a start of image formation of the second page is shorter than a predetermined period.

9. An image forming apparatus according to claim 7, wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page.

10. An image forming apparatus comprising:

an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and a transferring portion for transferring the developed image onto a recording medium;

a receiving unit which receives time information on a time required to start image formation of a second page subsequent to a first page;

a control unit which controls said image forming unit; and an image processing unit which processes image information from an external device, wherein said control unit determines whether to continue or to temporarily stop an application of the AC voltage to the image carrier between the first and second pages of image formations in accordance with the time information, wherein said image processing unit transmits image formation start instructions for the first and second pages to said receiving unit, and wherein the image formation start instruction for the second page includes the time information.

11. An image forming apparatus according to claim 10, wherein said control unit determines to temporarily stop the application of the AC voltage to the image carrier when the period to a start of image formation of the second page is longer than a predetermined period, and to continue the application of the AC voltage to the image carrier when the period to a start of image formation of the second page is shorter than a predetermined period.

12. An image forming apparatus according to claim 10, wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page.

13. An image forming apparatus comprising:

an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and transferring portion for transferring the developed image onto a recording medium;

a receiving unit which receives time information on a time required to start image formation of a second page subsequent to a first page; and a control unit which controls said image forming unit, wherein said control unit determines whether to continue or to temporarily stop an application of the AC voltage to the image carrier between the first and second pages of image formations in accordance with the time information, and wherein, when the time information has been received by said receiving unit before a reception of information regarding an image formation condition for the second page, said control unit determines whether the period from the end of image formation of the first page to a start of image formation of the second page is longer than a predetermined period or not based on the time information.

14. An image forming apparatus according to claim 13, wherein said control unit determines to temporarily stop the application of the AC voltage to the image carrier when the period to a start of image formation of the second page is longer than a predetermined period, and to continue the application of the AC voltage to the image carrier when the period to a start of image formation of the second page is shorter than a predetermined period.

15. An image forming apparatus according to claim 13, wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page.

16. An image forming apparatus comprising:

an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and a transferring portion for transferring the developed image onto a recording medium;

a receiving unit which receives time information on a time required to start image formation of a second page subsequent to a first page; and a control unit which controls said image forming unit, wherein said control unit determines whether to continue or to temporarily stop an application of the AC voltage to the image carrier between the first and second pages of image formations in accordance with the time information, and wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page, and said control unit starts the preparation operation according to a timing based on the time information.

17. An image forming apparatus according to claim 16, wherein said control unit starts the preparation operation immediately if time represented by the time information is equal to or shorter than a predetermined time.

18. An image forming apparatus according to claim 16, wherein said control unit starts the preparation operation at a timing when a different time has elapsed in accordance with the time information, if time represented by the time information is longer than a predetermined time.

19. An image forming apparatus according to claim 16, wherein said control unit starts the preparation operation in response to an image formation start instruction for the second page if the image formation start instruction has been received before the preparation operation is started.

20. An image forming apparatus according to claim 16, wherein said control unit alters driving condition of an actuator necessary for the printing operation or charging voltage applied to an electrophotographic photosensitive body if the image formation start instruction has not been received during the preparation operation.

21. An image forming apparatus according to claim 16, wherein said control unit determines to temporarily stop the application of the AC voltage to the image carrier when the period to a start of image formation of the second page is longer than a predetermined period, and to continue the application of the AC voltage to the image carrier when the period to a start of image formation of the second page is shorter than a predetermined period.

22. An image forming apparatus according to claim 16, wherein, in a case that said control unit determines to temporarily stop the application of the AC voltage to the image carrier, an end operation including a falling operation necessary for the charging portion to stop the AC voltage are executed after image formation of the first page, and thereafter, a preparation operation including a rising operation necessary for the charging portion to apply the AC voltage to the image carrier are executed before image formation of the second page.

23. An image forming method comprising:

a step of starting image formation of a first page by an image forming unit which has an image carrier, a charging portion which applies a predetermined voltage including AC voltage to the image carrier, an exposure portion which exposes the image carrier charged by the charging portion to form an electrostatic latent image, a developing portion which develops the electrostatic latent image and transferring portion for transferring the developed image onto a recording medium;

a reception step of receiving time information on whether or not a time required to start image formation of a second page subsequent to the first page; and a control step of controlling said image forming unit to continues or temporarily stops an operation of said image forming unit including an application of the AC voltage to the image carrier in a period from the end of image formation of the first page to a start of image formation of the second page in accordance with the time information, wherein said control step includes a step of executing predetermined end operation and predetermined preparation operation when temporarily stopping the operation of said image forming unit, and the operation of said image forming unit including an application of the AC voltage to the image carrier in a period from the end of image formation of the first page to a start of image formation of the second page is temporarily stopped in said control step, in accordance with whether or not the required time is longer than a predetermined time includes a time necessary to execute the predetermined preparation operation and the predetermined end operation.

24. The method according to claim 23, wherein the preparation operation includes an operation necessary to apply the AC voltage to the image carrier by the charging portion, and wherein the end operation includes an operation necessary to stop the AC voltage to the image carrier by the charging portion.

25. The method according to claim 23, wherein the required time is based on a switching time taken to switch from a first stacking portion which stacks a delivered recording medium of the first page to a second stacking portion which stacks a delivered recording medium of the second page.

26. The method according to claim 23, wherein the required time is based on further comprising a reception step of receiving a processing time necessary to process image information of the second page by an image processing section which processes image information from an external device.

27. The method according to claim 23, further comprising:

a first determination step of determining whether information on the required time has been received after the step of starting image formation is executed; and a second determination step of determining whether or not the required time is longer than a predetermined time, when the required time has been received.

28. The method according to claim 23, wherein the reception step includes a step of receiving pieces of information on image formation conditions of the first and second pages, wherein the image forming method further comprises a first determination step of determining whether the information on the image formation condition of the second page includes information on the required time, and wherein a second determination step of determining whether or not the required time has been received.

29. The method according to claim 23, wherein the step of starting image formation includes a step of starting image formation on the basis of an image formation start instruction for the first page that is output from an image processing unit which processes image information from an external device, wherein the image forming method further comprises a first determination step of determining whether the image formation start instruction includes an instruction on the required time, and wherein a second determination step of determines whether or not the required time is longer than a predetermined time, when the required time has been received.

30. The method according to claim 23, wherein said reception step includes a step of receiving pieces of information on image formation conditions of the first and second pages, wherein the image forming method further comprises a first determination step of determining whether information on the required time has been received before the information on the image formation condition of the second page is received, and wherein a second determination step of determines whether or not the required time has been received.

31. A method of controlling an image signal output unit that outputs an image signal and time information to an image forming unit, said method comprising:

a time notification step of notifying from said image signal output unit to the image forming unit of time information relating to time till output of the image signal becomes possible so that said image forming unit can determine whether to continue or temporarily stop an operation including an application of AC voltage to an image carrier and a timing for executing a preprocessing for performing the printing operation when the operation including the application of AC voltage to the image carrier is temporarily stopped, in accordance with the notified time information; and an image signal output step of outputting the image signal from the image signal output unit to the image forming unit at a timing substantially corresponding to the notified time information.

32. The method according to claim 31, wherein said image signal output step outputs the image signal in sync with a synchronizing signal from the image forming unit.

33. The method according to claim 31, further comprising a step of generating an image signal, which is to be output to the image forming unit, based upon information that has been output from a host computer.

34. The method according to claim 31, further comprising a step of transmitting information, which commands start of image formation, when output of the image signal has become possible.

35. The method according to claim 31, further comprising a prediction step of predicting time till output of the image signal becomes possible based upon information that has been output from a host computer, wherein the time information of which notification has been given at said time notification step is information indicating the time predicted at said prediction step.

* * * * *

UNITED STATES PATENT AND TRADEMARK OFFICE

CERTIFICATE OF CORRECTION

PATENT NO. : 7,251,424 B2
APPLICATION NO. : 10/742865
DATED : July 31, 2007
INVENTOR(S) : Yoshizawa It is certified that error appears in the above-identified patent and that said Letters Patent is hereby corrected as shown below:

COLUMN 3:
Line 47, “print-operations tart” should read -- print-operations start --.

COLUMN 5:
Line 37, “and” should be deleted; and
Line 39, “embodiment.” should read -- embodiment; --.

COLUMN 12:
Line 65, “203 3” should read -- 203 --.

COLUMN 13:
Line 3, “paper-sheet” should read -- paper-sheet --.

COLUMN 16:
Line 35, “command.” should read -- command. ¶(First Processing) --;
Line 38, “{time” should read -- (time --; and
Line 45, “of the AC” should read
-- of the second paper sheet after the suspend time designated by the image formation timing suspend command (timing 1109 in FIG. 11 and steps 1609 and 1610 in FIG. 16). If the engine control unit 203 has received a print start command till the end of the suspend time, the engine control unit 203 outputs a /TOP signal and starts image formation on the second paper sheet (steps 1612 and 1603). If the engine control unit 203 has not received any print start command till the end of the suspend time, the engine control unit 203 executes the post-rotation sequence and waits for transmission of the print start command for the second paper sheet (steps 1613 and 1614). --; and
Lines 46-50 should be deleted.

COLUMN 18:
Line 35, “Tp<Te” should read -- Tp≤Te --.

COLUMN 19:
Line 46, “Tp<Te” should read -- Tp≤Te --.

UNITED STATES PATENT AND TRADEMARK OFFICE

CERTIFICATE OF CORRECTION

PATENT NO. : 7,251,424 B2
APPLICATION NO. : 10/742865
DATED : July 31, 2007
INVENTOR(S) : Yoshizawa It is certified that error appears in the above-identified patent and that said Letters Patent is hereby corrected as shown below:

COLUMN 21:
Line 6, "that" should read -- than --; and
Line 53, "Tp<Te" should read -- Tp≤Te --.

COLUMN 23:
Line 27, "Tp<Te" should read -- Tp≤Te --.

COLUMN 25:
Line 51, "page:" should read -- page; --.

COLUMN 29:
Line 34, "continues or temporarily stops" should read -- continue or temporarily stop --.

COLUMN 30:
Line 26, "of determining" should read -- determines --;
Line 40, "of" should be deleted; and
Line 54, "of" should be deleted.

Signed and Sealed this

Twentieth Day of May, 2008

JON W. DUDAS
*Director of the United States Patent and Trademark Office*